US011856355B2

(12) United States Patent
Baba et al.

(10) Patent No.: US 11,856,355 B2
(45) Date of Patent: Dec. 26, 2023

(54) INFORMATION PROCESSING SYSTEM AND NON-TRANSITORY COMPUTER READABLE MEDIUM STORING PROGRAM

(71) Applicant: Agama-X Co., Ltd., Tokyo (JP)

(72) Inventors: Motofumi Baba, Kanagawa (JP); Kengo Tokuchi, Kanagawa (JP)

(73) Assignee: Agama-X Co., Ltd., Tokyo (JP)

( * ) Notice: Subject to any disclaimer, the term of this patent is extended or adjusted under 35 U.S.C. 154(b) by 0 days.

(21) Appl. No.: 17/986,925

(22) Filed: Nov. 15, 2022

(65) Prior Publication Data

US 2023/0076497 A1 Mar. 9, 2023

Related U.S. Application Data

(63) Continuation of application No. 17/396,794, filed on Aug. 9, 2021, now Pat. No. 11,533,552, which is a continuation of application No. 16/842,752, filed on Apr. 7, 2020, now Pat. No. 11,115,747.

(30) Foreign Application Priority Data

Dec. 3, 2019 (JP) ..... 2019-219154

(51) Int. Cl.
*H04R 1/10* (2006.01)

(52) U.S. Cl.
CPC ..... *H04R 1/1041* (2013.01); *H04R 2430/01* (2013.01); *H04R 2460/01* (2013.01)

(58) Field of Classification Search
CPC ..... H04R 1/1041
See application file for complete search history.

(56) References Cited

U.S. PATENT DOCUMENTS

| | | | | |
|---|---|---|---|---|
| 8,798,283 | B2 | 8/2014 | Gauger, Jr. et al. | |
| 9,953,626 | B2 | 4/2018 | Gauger, Jr. et al. | |
| 10,074,354 | B2 | 9/2018 | Gauger, Jr. et al. | |
| 10,362,385 | B1 * | 7/2019 | Di Censo | H04R 1/1083 |
| 2010/0217100 | A1 | 8/2010 | LeBoeuf et al. | |
| 2012/0281856 | A1 | 11/2012 | Georgiou et al. | |
| 2014/0140567 | A1 | 5/2014 | LeBoeuf et al. | |
| 2015/0092972 | A1 | 4/2015 | Lai et al. | |
| 2015/0164361 | A1 | 6/2015 | Lunner | |
| 2016/0210407 | A1 * | 7/2016 | Hwang | G16B 50/30 |
| 2016/0351183 | A1 | 12/2016 | Gauger, Jr. et al. | |
| 2017/0039045 | A1 | 2/2017 | Abrahami et al. | |
| 2017/0041699 | A1 | 2/2017 | Mackellar et al. | |

(Continued)

FOREIGN PATENT DOCUMENTS

| | | |
|---|---|---|
| JP | 2002-035130 | 2/2002 |
| JP | 2013-501969 | 11/2012 |

(Continued)

OTHER PUBLICATIONS

Notice of Allowance dated May 13, 2021 from the US Patent and Trademark Office Re. U.S. Appl. No. 16/842,752. (8 pages).

(Continued)

*Primary Examiner* — Simon King

(57) ABSTRACT

An information processing system includes a processor configured to detect biological information measured at a head and control a volume of an ambient sound output from a speaker provided in a device which is worn so as to cover an ear according to the detected biological information.

19 Claims, 20 Drawing Sheets

(56) References Cited

U.S. PATENT DOCUMENTS

| | | | | |
|---|---|---|---|---|
| 2018/0075659 | A1* | 3/2018 | Browy | G06F 40/58 |
| 2018/0133431 | A1 | 5/2018 | Malchano et al. | |
| 2018/0133507 | A1* | 5/2018 | Malchano | A61B 5/0036 |
| 2018/0232197 | A1 | 8/2018 | Ishihara | |
| 2018/0260187 | A1 | 9/2018 | Yasuda | |
| 2020/0265823 | A1 | 8/2020 | Kremer et al. | |
| 2020/0268260 | A1 | 8/2020 | Tran | |
| 2020/0296500 | A1 | 9/2020 | Wang | |
| 2021/0168486 | A1 | 6/2021 | Baba et al. | |
| 2021/0368257 | A1 | 11/2021 | Baba et al. | |
| 2022/0008746 | A1* | 1/2022 | Malchano | A61B 5/0036 |

FOREIGN PATENT DOCUMENTS

| | | |
|---|---|---|
| JP | 2014-030254 | 2/2014 |
| JP | 2017-069687 | 4/2017 |
| JP | 2017-079346 | 4/2017 |
| JP | 2018-120267 | 8/2018 |
| JP | 2018-187287 | 11/2018 |
| JP | 2019-004488 | 1/2019 |
| JP | 2019-152861 | 9/2019 |

OTHER PUBLICATIONS

Notice of Allowance dated Aug. 29, 2022 From the US Patent and Trademark Office Re. U.S. Appl. No. 17/396,794. (8 Pages).

Official Action dated Jan. 28, 2021 From the US Patent and Trademark Office Re. U.S. Appl. No. 16/842,752. (13 Pages).

Notice of Reasons for Refusal dated Mar. 14, 2023 From the Japan Patent Office Re. Application No. 2019-219154 and Its Translation Into English. (9 Pages).

Notice of Reasons for Refusal dated Sep. 12, 2023 From the Japan Patent Office Re. Application No. 2019-219154 and Its Translation Into English. (8 Pages).

* cited by examiner

FIG. 5

231

| No. | CHARACTERISTICS OF BRAIN WAVE INFORMATION | STATE OF USER |
|---|---|---|
| ⋮ | ⋮ | ⋮ |
| 10010 | CHARACTERISTIC AA ($\gamma$ WAVE) | EXCITED STATE (UNPLEASANT STATE) |
| 10011 | CHARACTERISTIC BB ($\beta$ WAVE) | CONCENTRATED STATE |
| 10012 | CHARACTERISTIC CC ($\alpha$ WAVE) | RELAXED STATE |
| 10013 | CHARACTERISTIC DD ($\theta$ WAVE) | LIGHT SLEEP STATE |
| 10014 | CHARACTERISTIC EE ($\delta$ WAVE) | DEEP SLEEP STATE |
| ⋮ | ⋮ | ⋮ |

MEASUREMENT RESULTS BY EARPHONE 10 (EXEMPLARY EMBODIMENT)
CONFIRMATION OF ARTIFACTS DURING EYE-OPENING AND EYE CLOSURE: WITHOUT BLINKING

MEASUREMENT RESULTS BY EARPHONE 10 (EXEMPLARY EMBODIMENT)
(CONFIRMATION OF ARTIFACTS DURING EYE-OPENING AND EYE CLOSURE:
WITH BLINKING + WITH OPERATION OF JAW)

CHANGE IN RATIO OF SPECTRUM INTENSITIES IN CASE IN WHICH STATE CHANGES FROM EYE-OPEN STATE WITH BLINKING TO EYE-CLOSED STATE IN WindWave CHANGE IN RATIO OF SPECTRUM INTENSITIES IN CASE IN WHICH STATE CHANGES FROM EYE-OPEN STATE WITHOUT BLINKING TO EYE-CLOSED STATE IN WindWave IN CASE IN WHICH INCREASE IN α-WAVES DOES NOT APPEAR IN WindWave

FIG. 13A

CHANGE IN RATIO OF SPECTRUM INTENSITIES IN CASE IN WHICH STATE CHANGES FROM EYE-OPEN STATE WITH BLINKING TO EYE-CLOSED STATE IN EARPHONE 10 (EXEMPLARY EMBODIMENT)

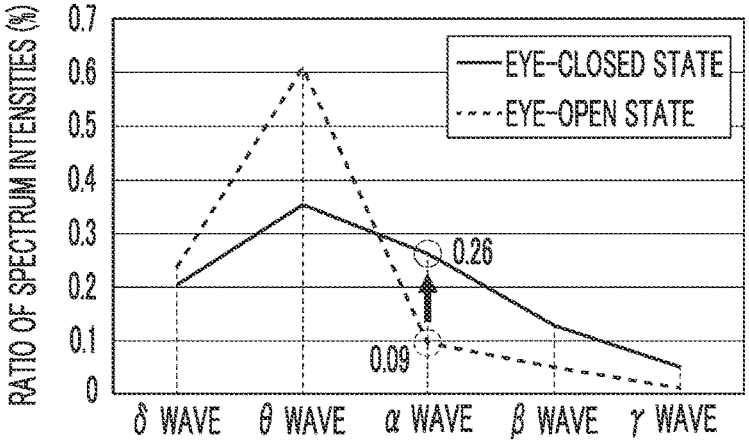

FIG. 13B

CHANGE IN RATIO OF SPECTRUM INTENSITIES IN CASE IN WHICH STATE CHANGES FROM EYE-OPEN STATE WITHOUT BLINKING TO EYE-CLOSED STATE IN EARPHONE 10 (EXEMPLARY EMBODIMENT)

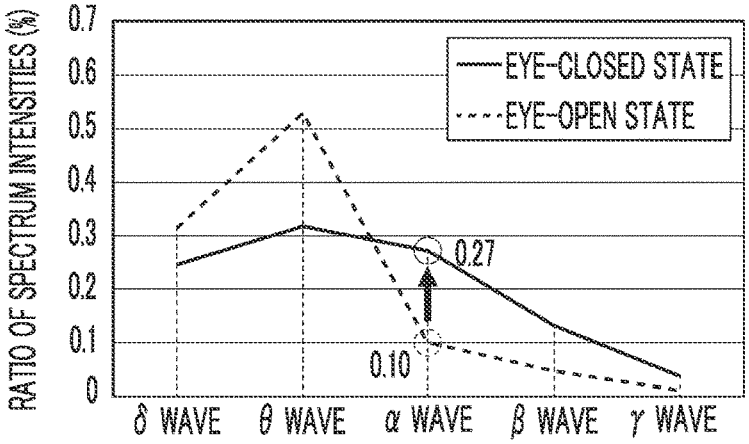

FIG. 13C

IN CASE IN WHICH INCREASE IN δ-WAVES DOES NOT APPEAR IN EARPHONE 10 (EXEMPLARY EMBODIMENT)

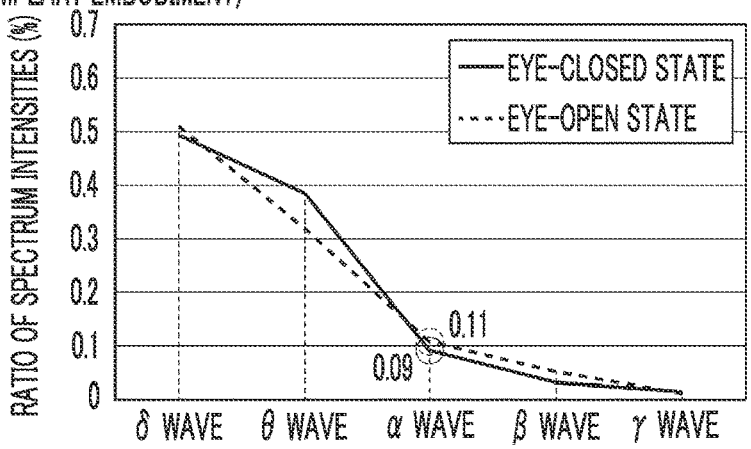

MEASUREMENT RESULTS BY MindWave

MEASUREMENT RESULTS BY EARPHONE 10 (EXEMPLARY EMBODIMENT)

INFORMATION PROCESSING SYSTEM AND NON-TRANSITORY COMPUTER READABLE MEDIUM STORING PROGRAM

RELATED APPLICATIONS

This application is a Continuation of U.S. patent application Ser. No. 17/396,794 filed Aug. 9, 2021, which is a Continuation of U.S. patent application Ser. No. 16/842,752 filed on Apr. 7, 2020, which claims the benefit of priority of Japanese Patent Application No. 2019-219154 filed on Dec. 3, 2019, the contents of which are incorporated herein by reference in their entirety.

FIELD AND BACKGROUND OF THE INVENTION

(i) Technical Field

The present invention relates to an information processing system and a non-transitory computer readable medium storing a program.

(ii) Related Art

Earphones have a structure that covers the external acoustic openings of the ears. In addition, headphones have a structure that covers the ears. Therefore, it is difficult for the user who wears the devices to hear the ambient sound naturally. In consideration of this inconvenience, there is a device having a function capable of capturing the ambient sound without being removed. This function is called, for example, an ambient sound capture function. In contrast, there is a device having a function of actively blocking unwanted ambient sounds. This function is called a so-called noise canceling function.

JP2019-004488A is an example of the related art.

SUMMARY OF THE INVENTION

However, it is necessary for the user to manually switch between the capturing and the blocking of the ambient sound in a device having a structure that covers the ears.

Aspects of non-limiting embodiments of the present disclosure relate to an information processing system and a non-transitory computer readable medium storing a program that can automatically adjust the volume of an ambient sound, unlike a case in which the switching of the input amount or output amount of the ambient sound is performed by an operation of a user.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an information processing system including a processor configured to detect biological information measured at a head and control a volume of an ambient sound output from a speaker provided in a device which is worn so as to cover an ear according to the detected biological information.

BRIEF DESCRIPTION OF THE SEVERAL VIEWS OF THE DRAWINGS

Exemplary embodiment(s) of the present invention will be described in detail based on the following figures, wherein:

FIG. 5 is a diagram illustrating an example of a table used in the exemplary embodiment;

FIG. 10A illustrates the measurement results in a case in which two sets of switching between an eye-open state and an eye-closed state without blinking are performed and FIG. 10B illustrates the measurement results in a case in which two sets of switching between the eye-open state and the eye-closed state with blinking are performed;

FIG. 11A illustrates the measurement results in a case in which two sets of switching between the eye-open state and the eye-closed state without blinking are performed and FIG. 11B illustrates the measurement results in a case in which two sets of switching between the eye-open state and the eye-closed state with blinking and the movement of the jaw are performed;

FIG. 12A illustrates a change in the ratio of spectrum intensities for each frequency band in a case in which the user's state changes from the eye-open state with blinking to the eye-closed state, FIG. 12B illustrates a change in the ratio of spectrum intensities for each frequency band in a case in which the user's state changes from the eye-open state without blinking to the eye-closed state, and FIG. 12C illustrates a case in which an increase in α-waves does not appear;

FIGS. 13A, 13B and 13C are diagrams illustrating measurement results by the earphone used in the exemplary embodiment: FIG. 13A illustrates a change in the ratio of spectrum intensities for each frequency band in a case in which the user's state changes from the eye-open state with blinking to the eye-closed state, FIG. 13B illustrates a change in the ratio of spectrum intensities for each frequency band in a case in which the user's state changes from the eye-open state without blinking to the eye-closed state, and FIG. 13C illustrates a case in which an increase in α-waves does not appear;

FIG. 14A illustrates the measurement results by MindWave and FIG. 14B illustrates the measurement results by the earphone used in the exemplary embodiment;

FIG. 17A is a diagram illustrating an example of the mounting of the headset and FIG. 17B is a diagram illustrating an example of the arrangement of the electrodes in the headset;

DESCRIPTION OF SPECIFIC EMBODIMENTS OF THE INVENTION

Hereinafter, exemplary embodiments of the invention will be described with reference to the drawings.

Exemplary Embodiment

System Configuration

Figure 1:
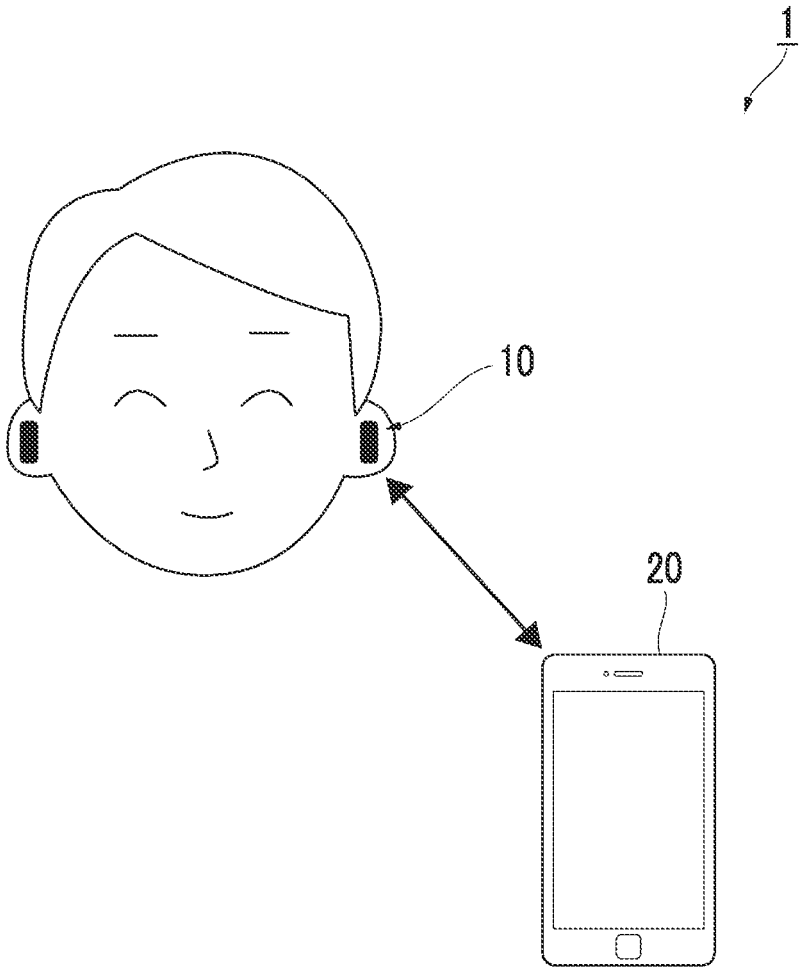
FIG. 1 is a diagram schematically illustrating a configuration of an earphone system used in an exemplary embodiment.

FIG. 1 is a diagram schematically illustrating the configuration of an earphone system 1 used in an exemplary embodiment.

The earphone system 1 illustrated in FIG. 1 includes an earphone 10 that is worn so as to cover the external acoustic opening and an information terminal 20 that is wirelessly connected to the earphone 10. The earphone 10 according to this exemplary embodiment can be used as a so-called earplug in a case in which power is turned off since the earphone 10 physically covers the external acoustic opening.

The earphone 10 and the information terminal 20 in this exemplary embodiment are examples of an information processing system.

The earphone 10 according to this exemplary embodiment is provided with a circuit that measures an electric signal (hereinafter, referred to as a "brain wave") caused by the activity of the brain, in addition to a circuit that reproduces a sound received from the information terminal 20. The earphone 10 used in this exemplary embodiment is a wireless device. Therefore, the earphone 10 is connected to the information terminal 20 by wireless communication.

In this exemplary embodiment, Bluetooth (registered trademark) is used for wireless connection between the earphone 10 and the information terminal 20. WiFi (registered trademark) or other communication standards can be used for the wireless connection. In addition, the earphone 10 and the information terminal 20 may be connected to each other by a cable.

The information terminal 20 has a function that estimates the state of the user from information (hereinafter referred to as "brain wave information") related to brain waves included in a digital signal received from the earphone 10 and automatically controls the volume of sound around the user (hereinafter, referred to as "ambient sound") output from the earphone 10 according to the estimated state of the user.

Automatic volume control includes reducing the ambient sound to a volume that the user does not care about. The control of reducing the volume of the ambient sound to the volume that the user does not care about includes controlling the volume of the ambient sound to zero.

In this exemplary embodiment, the control of the volume of the ambient sound output from the earphone 10 means controlling the volume of the ambient sound that can be heard by the user wearing the earphone 10. That is, the volume of the ambient sound in this exemplary embodiment does not mean control for increasing or decreasing the physical volume of the ambient sound output from a speaker (not illustrated), but means control for the volume perceived by the user in a case in which the user wears the earphone 10. For example, a so-called noise canceling function outputs a sound having a phase opposite to the phase of the ambient sound from the earphone 10 to making it difficult to hear the ambient sound.

In this exemplary embodiment, in a case in which the volume of the ambient sound is forcibly suppressed, the noise canceling function is controlled to be turned on. As a result, the user who wears the earphone 10 does not perceive the presence of the ambient sound or perceives the ambient sound only to the extent that the user does not care about the ambient sound.

Whether or not the user perceives the ambient sound is also related to the volume of music or voice output from the earphone 10.

For example, in a case in which the volume of music or voice output from the earphone 10 is low even though the volume of the ambient sound output from the earphone 10 is the same, the user may perceive the ambient sound. In a case in which the volume of music or voice output from the earphone 10 is high, the user may not perceive the ambient sound.

In this exemplary embodiment, the minimum value of the volume at which the user can perceive the presence of the ambient sound in relation to the volume of music or voice output from the earphone 10 is referred to as a "reference volume".

Therefore, in order to prevent the user from perceiving the ambient sound, it is necessary to set the volume of the ambient sound output from the earphone 10 to be less than the reference volume.

On the other hand, in order to make the user perceive the ambient sound, it is necessary to set the volume of the ambient sound output from the earphone 10 to be higher than the reference volume.

However, there is a large individual difference in how individuals perceive sound. For example, even in a case in which the volume is the same, some sounds are audible to young people and are inaudible to old people or difficult to hear for old people. In addition, sound may or may not be heard depending on the physical conditions. Further, there is an individual difference in hearing. For this reason, it is difficult to set the "reference volume" common to any users.

Therefore, in this exemplary embodiment, the "reference volume" is not used in a strict sense, but is used in a rough sense. That is, not only the volume at which the user does not perceive the ambient sound but also the volume at which the user perceives the ambient sound, but do not care about the ambient sound is treated as volume lower than the reference volume.

That is, the reduction of the ambient sound in this exemplary embodiment may be equivalent to that in the noise canceling function of commercially available earphones.

Similarly, the volume at which the ambient sound is perceived may be equivalent to that in the ambient sound capturing function of commercially available earphones.

However, in the case of the commercially available earphones, the user needs to manually turn on each function in order to enable the functions. Similarly, the user needs to manually turn off each function in order to disable the functions.

In the case of this exemplary embodiment, the user only needs to wear the earphone 10. The information terminal 20 according to this exemplary embodiment estimates the state of the user from the brain wave information of the user measured by the earphone 10 and controls the volume of the ambient sound according to the estimated state of the user. The content of this control will be described in detail below.

In the example illustrated in FIG. 1, a smart phone is assumed as the information terminal 20. Of course, the information terminal 20 may be a tablet terminal, a notebook computer, or a wearable computer.

Hereinafter, in this exemplary embodiment, the reason why the earphone 10 is used for measuring brain waves will be described. The brain wave is an example of biological information measured at the head.

In a case in which the spread of devices that can measure the brain waves is considered, there is a possibility that wearing a device that apparently measures brain waves will not be supported by the user. For example, there is a possibility that a helmet-type device will not be supported by the user from the viewpoint of design and the burden on the body.

For the above reasons, in this exemplary embodiment, the earphone 10 is used as a device for measuring brain waves. Since the earphone 10 is widely used as a so-called audio device, it is considered that there is little psychological resistance to wearing the earphone.

In addition, since the external acoustic opening into which the earphone 10 is put is close to the brain, the external acoustic opening is also an ideal part for measuring brain waves. The fact that the brain waves can be measured by the earphone 10 will be described below in the section of experimental results which will be described below.

The external acoustic opening is an example of the ear. The ear according to this exemplary embodiment is used in a sense including the auricle and the external acoustic opening. In addition, the earphone 10 is appropriate for acquiring the ambient sound.

Configuration of Earphone 10

Figure 2:
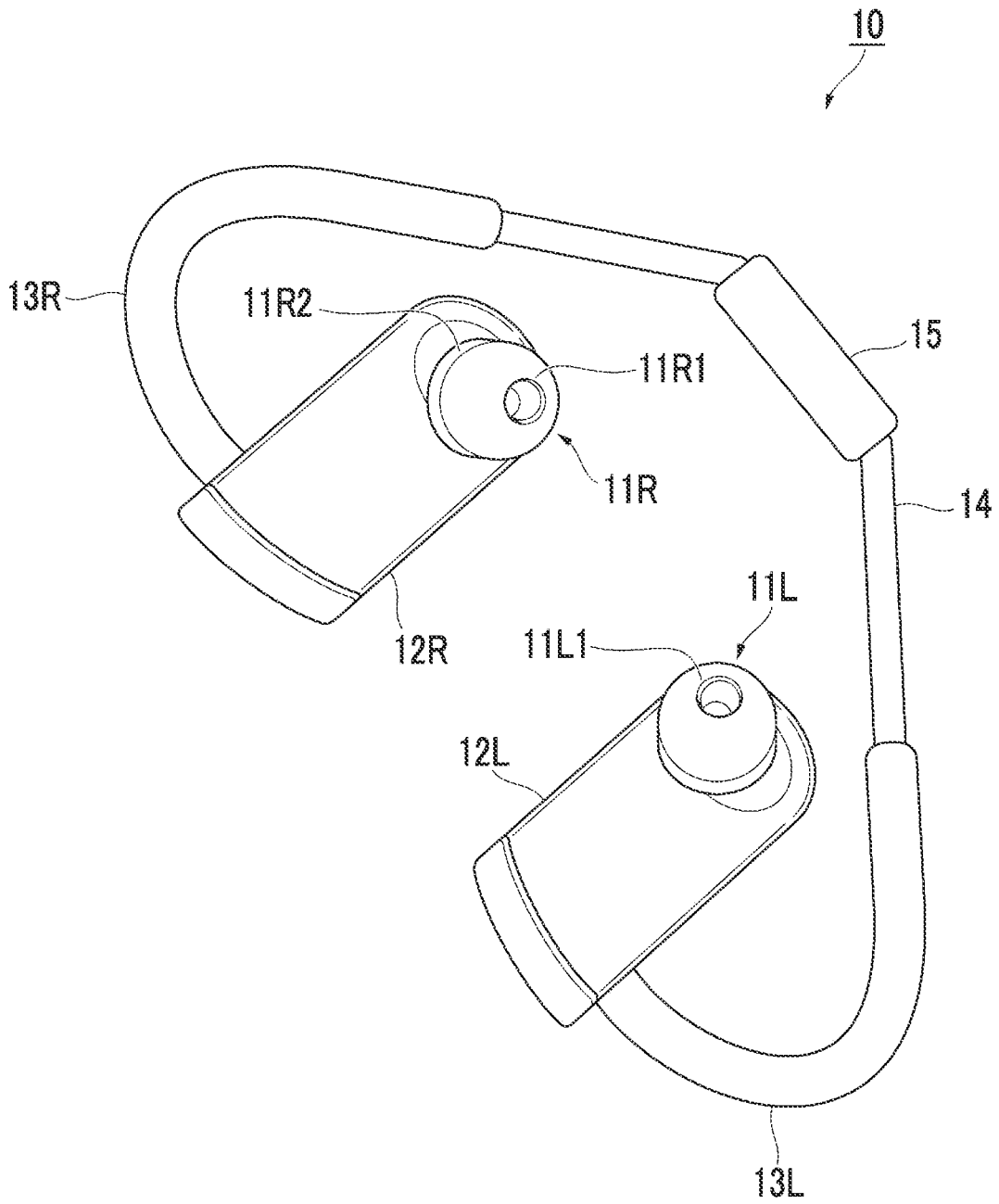
FIG. 2 is a diagram illustrating an example of an external configuration of an earphone used in the exemplary embodiment.

FIG. 2 is a diagram illustrating an example of the external configuration of the earphone 10 used in the exemplary embodiment.

The earphone 10 includes earphone chips 11R and 11L that are inserted into the external acoustic openings, earphone bodies 12R and 12L to which the earphone chips 11R and 11L are attached, respectively, ear hooks 13R and 13L that are placed in a gap between the auricle and a temporal region, a cable 14 that connects the earphone bodies 12R and 12L, and a controller 15 having a power button and a volume button provided thereon.

In FIG. 2, R indicates a right ear side of the user and L indicates a left ear side of the user.

The earphone chip 11R according to this exemplary embodiment includes a dome-shaped electrode 11R1 that is inserted into the external acoustic opening and comes into contact with the inner wall of the external acoustic opening and a ring-shaped electrode 11R2 that comes into contact with the cavity of the concha.

Both the electrode 11R1 and the electrode 11R2 according to this exemplary embodiment are made of conductive rubber. The electrodes are for measuring an electric signal that appears on the skin. The electrode 11R1 and the electrode 11R2 are electrically separated from each other by an insulator.

In this exemplary embodiment, the electrode 11R1 is a terminal (hereinafter, referred to as an "EEG measurement terminal") that is used to measure a potential change caused by an electroencephalogram (EEG).

The electrode 11R2 is a ground electrode (hereinafter, also referred to as a "GND terminal").

The earphone chip 11L includes a dome-shaped electrode 11L1 that is inserted into the external acoustic opening and comes into contact with the inner wall of the external acoustic opening. In this exemplary embodiment, the electrode 11L1 is a terminal (hereinafter, referred to as a "REF terminal") that is used to measure a reference potential (REF). However, in this exemplary embodiment, the electrode 11R2 and the electrode 11L1 are electrically short-circuited.

In this exemplary embodiment, the potential change caused by the brain waves is measured as a difference signal between the electric signals measured by the electrodes 11R1 and 11L1.

In the field of brain science, all potential changes resulting from sources other than brain waves are called artifacts. In the field of brain science, it is considered that an electrical signal obtained by measuring brain waves always contains the artifact. In this exemplary embodiment, the potential change measured by the earphone 10 is referred to as an electric signal obtained by measuring brain waves, without distinguishing the origin of the potential change.

Incidentally, components included in the artifact are classified into components resulting from a living body, components resulting from a measurement system, such as an electrode, and components resulting from an external opportunity or environment. Among the three components, components other than the component resulting from the living body can be measured as noise measured by the earphone 10. The noise can be measured as an electric signal in a state in which the electrode 11R1 and the electrode 11L1 are electrically short-circuited.

The earphone main body 12R according to this exemplary embodiment includes, for example, a circuit that generates measurement signals of the brain waves and a potential change resulting from something other than the brain waves, a circuit that generates audio data from an electric signal output from a microphone (not illustrated), and a circuit that performs a process of decoding audio data received from the information terminal 20 (see FIG. 1) and outputting the decoded audio data to a speaker (not illustrated).

A battery is provided in the earphone main body 12L.

Figure 3:
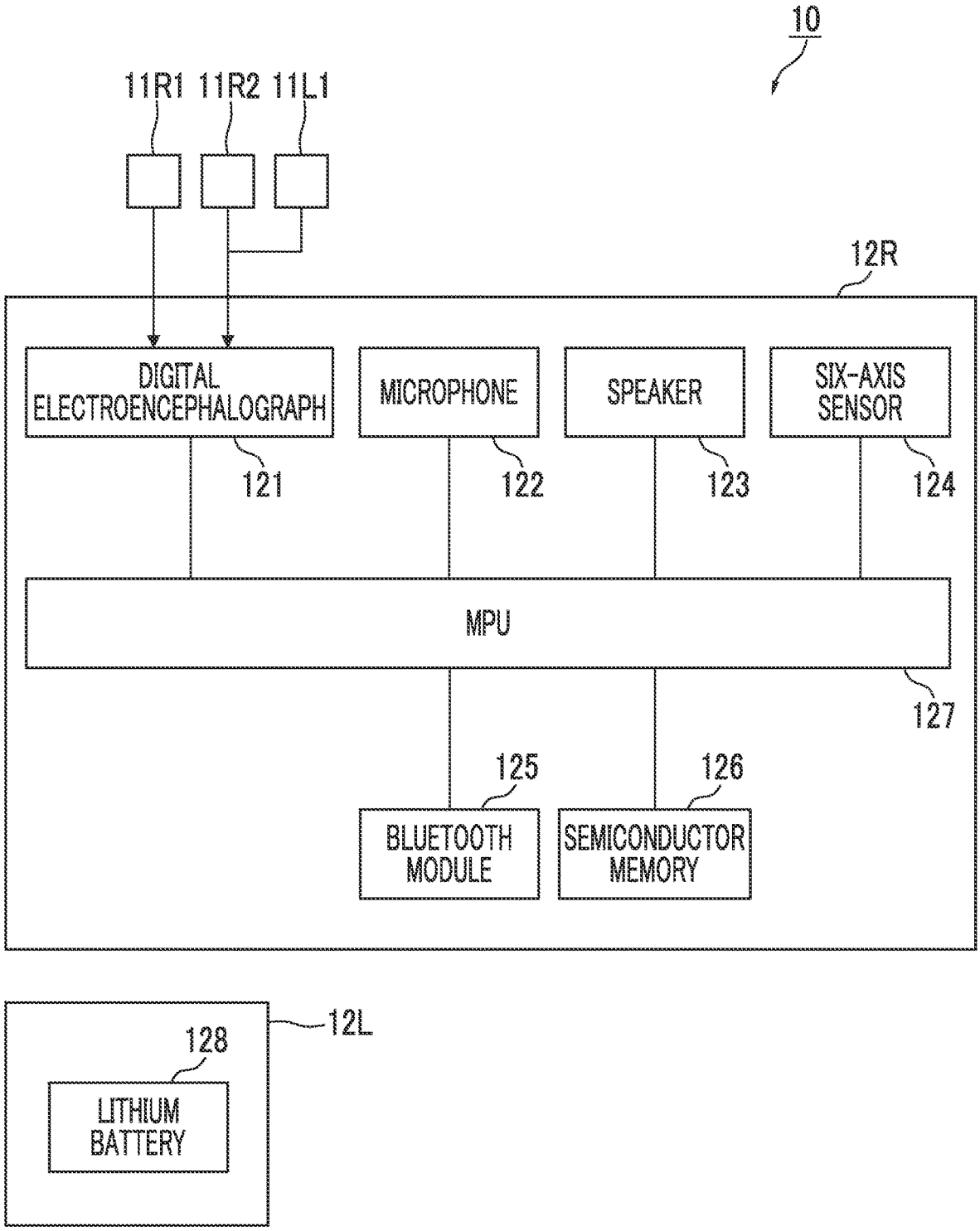
FIG. 3 is a diagram illustrating an example of an internal configuration of the earphone used in the exemplary embodiment.

FIG. 3 is a diagram illustrating an example of the internal configuration of the earphone 10 used in the exemplary embodiment.

FIG. 3 illustrates the internal configuration of the earphone bodies 12R and 12L of the earphone 10.

In this exemplary embodiment, the earphone main body 12R includes a digital electroencephalograph 121, a microphone 122, a speaker 123, a six-axis sensor 124, a Bluetooth module 125, a semiconductor memory 126, and a micro processing unit (MPU) 127.

The digital electroencephalograph 121 includes a differential amplifier that differentially amplifies a potential change appearing in the electrodes 11R1 and 11L1, a sampling circuit that samples the output of the differential amplifier, and an analog/digital conversion circuit that converts the sampled analog potential into a digital value. In this exemplary embodiment, a sampling rate is 600 Hz. The resolution of the analog/digital conversion circuit is 16 bits.

The microphone 122 includes a diaphragm that vibrates in response to voice uttered by the user, a voice coil that converts the vibration of the diaphragm into an electric signal, and an amplifier that amplifies the electric signal. In addition, an analog/digital conversion circuit that converts the analog potential of the electric signal output from the amplifier into a digital value is separately prepared.

The speaker 123 includes a diaphragm and a voice coil through which a current corresponding to audio data flows to make the diaphragm vibrates. In addition, a digital/analog conversion circuit converts audio data input from the MPU 127 into an analog signal.

The six-axis sensor 124 includes a three-axis acceleration sensor and a three-axis gyro sensor. The six-axis sensor 124 is used to detect the posture of the user.

The Bluetooth module 125 is used to transmit and receive data to and from the information terminal 20 (see FIG. 1). In this exemplary embodiment, the Bluetooth module 125 is used to transmit the digital signal output by the digital electroencephalograph 121 or the audio data acquired by the microphone 122 to the information terminal 20 and is also used to receive the audio data from the information terminal 20.

In addition, the Bluetooth module 125 can be used to receive a signal (hereinafter, referred to as a "control signal") for controlling the volume of the ambient sound from the information terminal 20. However, in a case in which the ambient sound whose volume has been controlled is generated by the information terminal 20 and is then transmitted as audio data to the earphone 10, it is not necessary to receive the control signal for the volume of the ambient sound.

The semiconductor memory 126 includes, for example, a read only memory (ROM) storing a basic input output system (BIOS), a random access memory (RAM) used as a work area, and a rewritable non-volatile memory (hereinafter, referred to as a "flash memory").

In this exemplary embodiment, the flash memory is used to store, for example, the digital signal output from the digital electroencephalograph 121, the audio data acquired by the microphone 122, and the audio data received from the information terminal 20.

The MPU 127 controls, for example, the transmission and reception of digital signals to and from the information terminal 20, the processing of the digital signals to be transmitted to the information terminal 20, and the processing of the digital signals received from the information terminal 20. In this exemplary embodiment, the MPU 127 performs a process, such as Fourier transform, on the digital signal output from the digital electroencephalograph 121. The MPU 127 and the semiconductor memory 126 operate as a computer. A lithium battery 128 is provided in the earphone main body 12L.

Configuration of Information Terminal 20

Figure 4:
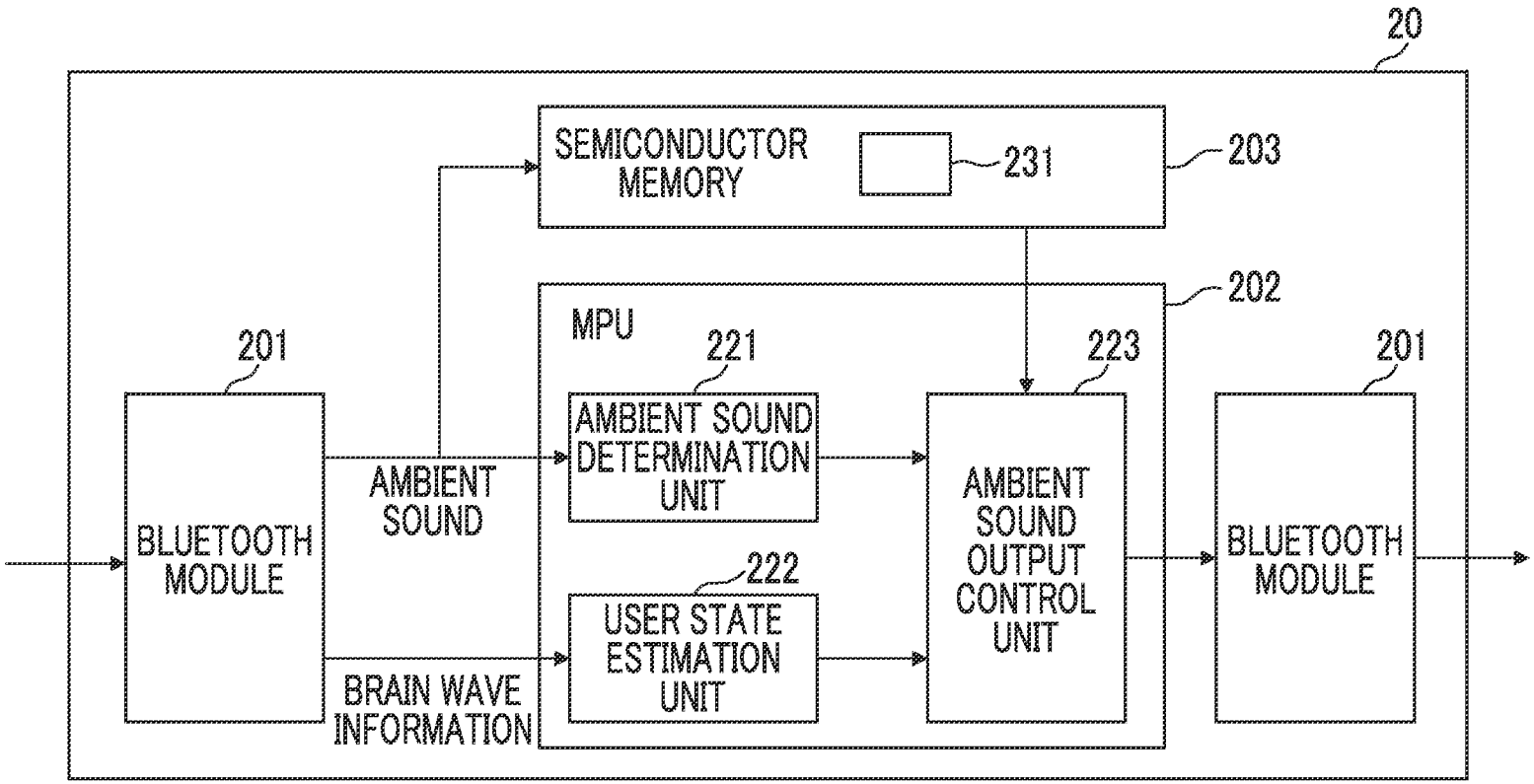
FIG. 4 is a diagram illustrating an example of an internal configuration of an information terminal used in the exemplary embodiment.

FIG. 4 is a diagram illustrating an example of the internal configuration of the information terminal 20 used in the exemplary embodiment.

In FIG. 4, among devices forming the information terminal 20, devices related to the function of controlling the volume of the ambient sound according to the state of the user estimated from the brain wave information are extracted and illustrated.

The information terminal 20 illustrated in FIG. 4 includes a Bluetooth module 201, an MPU 202, and a semiconductor memory 203. In FIG. 4, two Bluetooth modules 201 are illustrated. However, in practice, one Bluetooth module 201 is provided.

The Bluetooth module 201 is used for communication with the Bluetooth module 125 provided in the earphone 10.

The MPU 202 acquires brain wave information from the digital signal received from the earphone 10 and implements the function of estimating the state of the user. Here, the function is implemented by the execution of an application program. In this exemplary embodiment, the state of the user is used to mean the state of mind and body. In this exemplary embodiment, the state of mind and body is classified into an excited state, a concentrated state, a relaxed state, a light sleep state, and a deep sleep state. The classification of the state of mind and body is not limited to the exemplified states. The state of mind and body may be classified into a smaller number of states or a larger number of states.

The excited state is a state in which a large number of γ-wave are output. The γ-waves are also output in an irritated state or an unpleasant state.

The concentrated state is a state in which a large number of β-waves are output. It is said that the β-waves appear in daily life or working.

The relaxed state is a state in which a large number of α-waves are output. The α-waves are output even in a state in which the consciousness is concentrated. In addition, the state corresponding to the α-waves may be subdivided. There are three types of α-waves, that is, fast α-waves, middle α-waves, and slow α-waves. The fast, middle, and slow levels correspond to the height of frequencies. The fast level is classified as concentration with tension, the slow level is classified as concentration close to rest, and the middle level is classified as so-called relaxed concentration.

The light sleep state is a state in which a large number of θ-waves are output. It is said that the θ-waves are output in a state in which there is consciousness, but the level of consciousness is low.

The deep sleep state is a state in which a large number of δ-waves are output. It is said that the δ-waves are output in an unconscious state.

The MPU 202 illustrated in FIG. 4 functions as an ambient sound determination unit 221 that determines the content of the ambient sound included in the digital signal received from the earphone 10, a user state estimation unit 222 that estimates the state of the user from the brain wave information included in the digital signal received from the earphone 10, and an ambient sound output control unit 223 that controls, for example, the volume of the ambient sound output from the speaker 123 (see FIG. 3) of the earphone 10 according to the estimated state of the user and the content of the ambient sound.

The ambient sound determination unit 221 according to this exemplary embodiment determines, for example, whether the ambient sound received from the earphone 10 includes a voice including a predetermined term or a predetermined type of sound.

Examples of the predetermined term include the name of the user who wears the earphone 10, a calling word, and a greeting word. Further, an example of the predetermined term is a word indicating danger. Examples of the predetermined term include "dangerous" and "run away". In addition, for example, some announcements used in transport facilities can be included in the predetermined term.

Examples of the predetermined type of sound include siren sounds, bell sounds, and horn sounds. Siren sounds or horn sounds that call attention to danger or caution include sounds used in, for example, police vehicles, fire trucks, ambulances, and disaster prevention wireless systems. In addition, the bell sounds include the sound of an alarm clock, the sound of a timer, the sound of a fire alarm, and a sound indicating an earthquake motion with high seismic intensity.

The predetermined terms or the predetermined types of sounds are determined in the initial settings. However, some of the predetermined terms or the predetermined types of sounds may be edited or added by the user.

The user state estimation unit 222 according to this exemplary embodiment extracts the brain wave information from the digital signal received from the earphone 10 and estimates the state of the user on the basis of a large number of frequency components included in the brain wave information. For example, fast Fourier transform is used for frequency component decomposition. In this exemplary embodiment, the MPU 127 (see FIG. 3) of the earphone 10 (see FIG. 1) performs frequency component decomposition. Each frequency component is associated with the state of the user. The user state estimation unit 222 outputs, as an estimated value, a state associated with a large number of frequency components included in the brain wave information.

The brain wave information includes a plurality of frequency components. In this exemplary embodiment, the frequency component whose output has been confirmed to be larger than a threshold value determined for each frequency component is defined as a frequency component that is generally included in the brain wave information. However, in a case in which there are a plurality of frequency components greater than the threshold value, one frequency component may be determined according to a predetermined priority.

In addition, one frequency component that is assigned to an output pattern of a plurality of frequency components may be used as a representative frequency component, unlike the frequency component greater than the threshold value.

The ambient sound output control unit 223 according to this exemplary embodiment controls the volume of the ambient sound output from the speaker 123 (see FIG. 3) provided in the earphone 10 according to a combination of the estimated state of the user and the content of the ambient sound. Here, a volume control target is the volume of the ambient sound acquired by the microphone 122 (see FIG. 3) and is different from the volume of music reproduced by the information terminal 20 or the volume of the voice heard over the phone.

In this exemplary embodiment, the content of the control corresponding to the combination of the estimated state of the user and the content of the ambient sound is determined by a program. The relationship between the content of the control and the combination of the estimated state of the user and the content of the ambient sound may be prepared in a table.

In addition, the ambient sound output control unit 223 according to this exemplary embodiment has a function of reproducing the ambient sound recorded in the concentrated state from the speaker 123 (see FIG. 3) of the earphone 10 in a case in which the user changes from the concentrated state to the relaxed state. Here, since the ambient sound is reproduced to be heard by the user, the ambient sound is controlled such that the volume thereof is higher than the reference volume.

The reproduction of the recorded ambient sound may be performed on condition that the user wants to reproduce the ambient sound recorded in the concentrated state. The confirmation of the user's request may be performed using a confirmation screen displayed on a display unit of the information terminal 20 (see FIG. 1) or using a response to a question reproduced from the earphone 10. In this exemplary embodiment, in a case in which the user taps a specific button prepared on the confirmation screen, the information terminal 20 starts to reproduce the recorded ambient sound.

The semiconductor memory 203 according to this exemplary embodiment stores a table 231 in which the relationship between the characteristics of the brain wave information and the state of the user has been recorded.

FIG. 5 is a diagram illustrating an example of the table 231 used in the exemplary embodiment. The table 231 stores a management number, the characteristics of the brain wave information, and the corresponding state of the user.

In FIG. 5, the excited state is associated with a characteristic AA in which many γ-waves appear. The excited state includes an unpleasant state.

In addition, the concentrated state is associated with a character BB in which many β-waves appear. The relaxed state is associated with a characteristic CC in which many α-waves appear. The light sleep state is associated with a characteristic DD in which many θ-waves appear. The deep sleep state is associated with a characteristic EE in which many δ-waves appear. Hereinafter, the light sleep state and the deep sleep state are collectively referred to as a sleep state.

The table 231 is referred to by the user state estimation unit 222 (see FIG. 4) in a case in which the state of the user is estimated.

The semiconductor memory 203 includes a ROM in which a BIOS is stored, a RAM used as a work area, and a flash memory as an external storage memory, in addition to the table 231. The audio data of the ambient sound received from the earphone 10 is recorded on the flash memory. The ambient sound recorded on the flash memory is read by the ambient sound output control unit 223 and is output to the Bluetooth module 201 at a volume corresponding to the state of the user and the content of the ambient sound. In a case in which there is music that the user is listening to or a voice heard over the phone, audio data is generated by mixing the audio data of the music or the voice with the ambient sound.

Processing Operation of Information Terminal 20

Hereinafter, an example of a processing operation implemented by the execution of a program by the MPU 202 (see FIG. 4) in the information terminal 20 (see FIG. 1) will be described.

Figure 6:
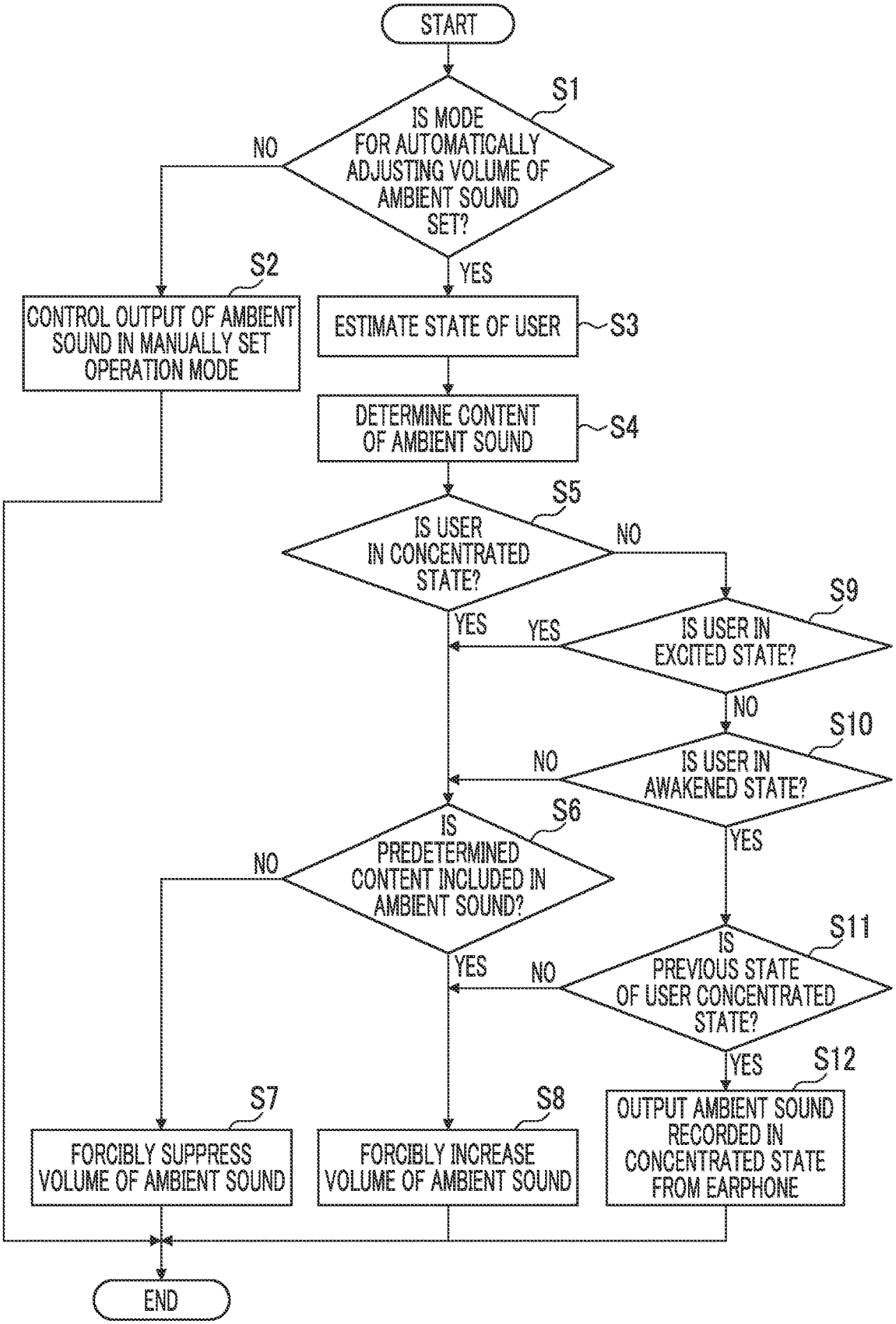
FIG. 6 is a flowchart illustrating an example of a processing operation performed by the information terminal that has received a digital signal including brain wave information.

FIG. 6 is a flowchart illustrating an example of the processing operation performed by the information terminal 20 that has received a digital signal including brain wave information. In FIG. 6, S means a step.

In this exemplary embodiment, the digital information including the brain wave information is transmitted from the earphone 10 (see FIG. 1) to the information terminal 20.

First, the MPU 202 determines whether or not a mode for automatically adjusting the volume of the ambient sound is set (Step S1).

In a case in which the determination result in Step S1 is "No", the MPU 202 controls the output of the ambient sound in the operation mode that has been manually set (Step S2). This control is provided as a portion of the function of the ambient sound output control unit 223 (see FIG. 4).

On the other hand, in a case in which the determination result in Step S1 is "Yes", the MPU 202 estimates the state of the user on the basis of the frequency components generally included in the brain wave information (Step S3). In this exemplary embodiment, one of the excited state, the concentrated state, the relaxed state, the light sleep state, and the deep sleep state is used as the estimated value of the state of the user.

Then, the MPU 202 determines the content of the ambient sound (Step S4). In addition, the order of Step S3 and Step S4 may be interchanged or Step S3 and Step S4 may be performed in parallel.

Then, the MPU 202 performs control corresponding to the current state and the content of the ambient sound.

In FIG. 6, the MPU 202 determines whether or not the user is in the concentrated state (Step S5). That is, the MPU 202 determines whether or not many β-waves have appeared in the brain wave information.

In a case in which the determination result in Step S5 is "Yes", the MPU 202 determines whether or not the ambient sound includes predetermined content (Step S6). The predetermined content is a predetermined term or a predetermined type of sound.

In a case in which the user is in the concentrated state and the ambient sound does not include the predetermined content, the MPU 202 obtains a negative result in Step S6. In this case, the MPU 202 forcibly suppresses the volume of the ambient sound (Step S7). As a result, the concentrated state of the user is not hindered. Further, the user does not need to individually perform the operation of suppressing the ambient sound.

In contrast, in a case in which the user is in the concentrated state and the predetermined content is included in the ambient sound, the MPU 202 obtains a positive result in Step S6. In this case, the MPU 202 forcibly increases the volume of the ambient sound (Step S8). As a result, the concentrated state is hindered, but the user can perceive a call or the danger of the body.

In a case in which the user is not in the concentrated state, the MPU 202 obtains a negative result in Step S5. In this case, the MPU 202 determines whether or not the user is in the excited state (Step S9). That is, the MPU 202 determines whether or not many γ-waves have appeared in the brain wave information.

In a case in which the user is in the excited state, the MPU 202 obtains a positive result in Step S9.

In a case in which the determination result in Step S9 is "Yes", the MPU 202 performs the determination in Step S6 and then performs a process corresponding to the result of the determination. That is, in a case in which the predetermined content is not included in the ambient sound, the MPU 202 forcibly suppresses the volume of the ambient sound so as not to stimulate the excited state of the user (Step S7). On the other hand, in a case in which the predetermined content is included in the ambient sound, the MPU 202 forcibly increases the volume of the ambient sound even though the user is in the excited state (Step S8).

In a case in which the user is not in the excited state, the MPU 202 obtains a negative result in Step S9.

In a case in which the negative result is obtained in Step S9, the MPU 202 determines whether or not the user is in an awakened state (Step S10). That is, the MPU 202 determines whether or not many α-waves appear in the brain wave information.

In a case in which the user is in the light sleep state or the deep sleep state, the MPU 202 obtains a negative result in Step S10.

In a case in which the negative result is obtained in Step S10, the MPU 202 performs the determination in Step S6 and then performs a process corresponding to the result of the determination. That is, in a case in which the predetermined content is not included in the ambient sound, the MPU 202 forcibly suppresses the volume of the ambient sound so as not to stimulate the sleep state of the user (Step S7). On the other hand, in a case in which the predetermined content is included in the ambient sound, the MPU 202 forcibly increases the volume of the ambient sound even though the user is in the sleep state (Step S8).

In a case in which the user is in the relaxed state, the MPU 202 obtains a positive result in Step S10.

In a case in which the positive result is obtained in Step S10, the MPU 202 determines whether or not the previous state of the user is the concentrated state (Step S11).

In a case in which the previous state of the user is the excited state or the sleep state, the MPU 202 obtains a negative result in Step S11. In this case, the MPU 202 according to this exemplary embodiment proceeds to Step S8 and performs a process of forcibly increasing the volume of the ambient sound. That is, in the relaxed state, control is performed such that the ambient sound can be heard.

However, in a case in which the previous state of the user is the concentrated state, the MPU 202 obtains a positive result in Step S11 and directs the earphone 10 to output the ambient sound recorded in the concentrated state (Step S12).

As described above, in a case in which the user is in the concentrated state, the MPU 202 performs control to forcibly reduce the volume of the ambient sound so as not to hinder the concentrated state as long as the predetermined content is not included in the ambient sound. On the other hand, in a case in which the concentrated state ends, there is a possibility that the user wants to check the content of the ambient sound in the concentrated state.

Therefore, in this exemplary embodiment, in a case in which the state changes from the concentrated state to the relaxed state, control is performed such that the ambient sound recorded in the concentrated state is output from the earphone 10. Step S12 may be performed only in a case in which the user sets the execution of Step S12 in advance. Further, a function may be provided which inquires of the user whether to output the recorded ambient sound before starting the output of the recorded ambient sound.

As described above, the earphone system 1 according to this exemplary embodiment estimates the state of the user who wears the earphone 10 covering the external acoustic opening using brain waves and automatically controls the volume of the ambient sound perceived by the user according to the estimated state. Therefore, the user does not need to manually perform an operation for hearing the ambient sound or an operation for not hearing the ambient sound. In other words, the user can continue his or her own action or activity, without being bothered with the ambient sound. For example, even in a case in which the user moves to a place where noise is severe, the user can enjoy the music and sound output from the earphone 10 without being conscious of the ambient sound.

It is possible to increase the volume such that the user is forced to hear the ambient sound including the sounds or terms of danger and user safety and user convenience are also considered.

Experimental Results

Next, the fact that the earphone 10 (see FIG. 2) can acquire the brain wave information of the user will be described through the results of experiments by a third party or the results of experiments by the applicant.

Reliability of MindWave (NeuroSky Inc.) Used for Comparison with Earphone 10

Figure 7:
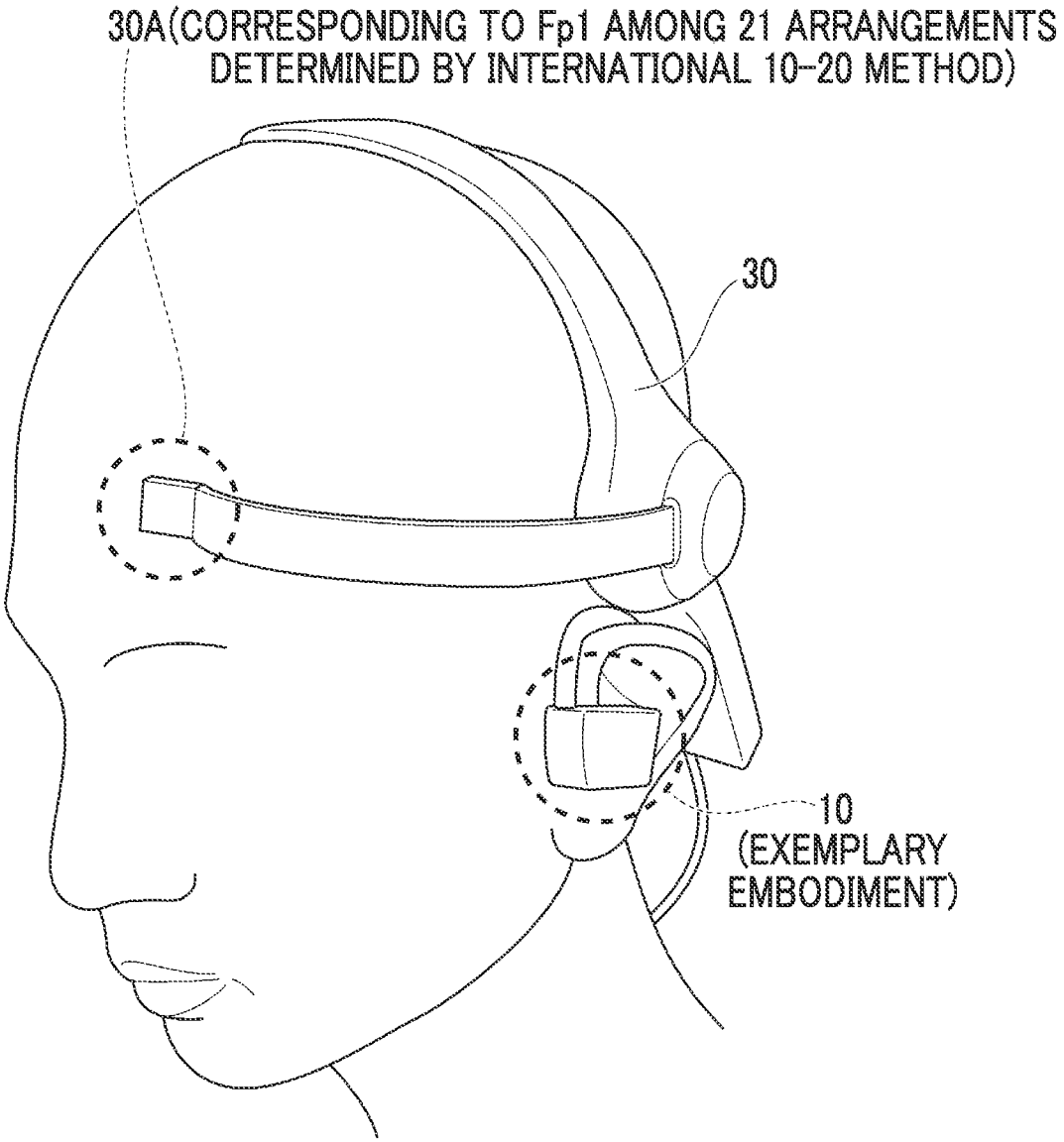
FIG. 7 is a diagram illustrating a measurement point of a headset with a brain wave sensor that can measure brain waves in a state in which the earphone is worn.

FIG. 7 is a diagram illustrating a measurement point of a headset 30 with a brain wave sensor which can measure brain waves in a state in which the earphone 10 is worn.

In this experiment, MindWave manufactured by NeuroSky, Inc. which is commercially available is used as the headset 30 with a brain wave sensor.

As described above, the earphone 10 uses the external acoustic opening as a brain wave measurement point. In contrast, MindWave manufactured by NeuroSky, Inc. uses the forehead 30A as a brain wave measurement point.

The forehead 30A illustrated in FIG. 7 corresponds to Fp1 of 21 arrangements which are defined by the 10-20 method recommended as an international standard for electrode arrangements used for brain wave measurement.

The brain waves measured by MindWave are equivalent to the brain waves in a medically certified EEG system and are verified by Elena Ratti et al., "Comparison of Medical and Consumer Wireless EEG Systems for Use in Clinical Trials" (https://www.frontiersin.org/articles/10.3389/fnhum.2017.0039 8/full).

This paper is peer-reviewed by Dimiter Dimitrov, Ph.D., Senior Scientist, Duke University, U.S. and Marta Parazzini, Ph.D., the Italian National Research Council (CNR), Milan Institute of Technology, Italy.

Figure 8:
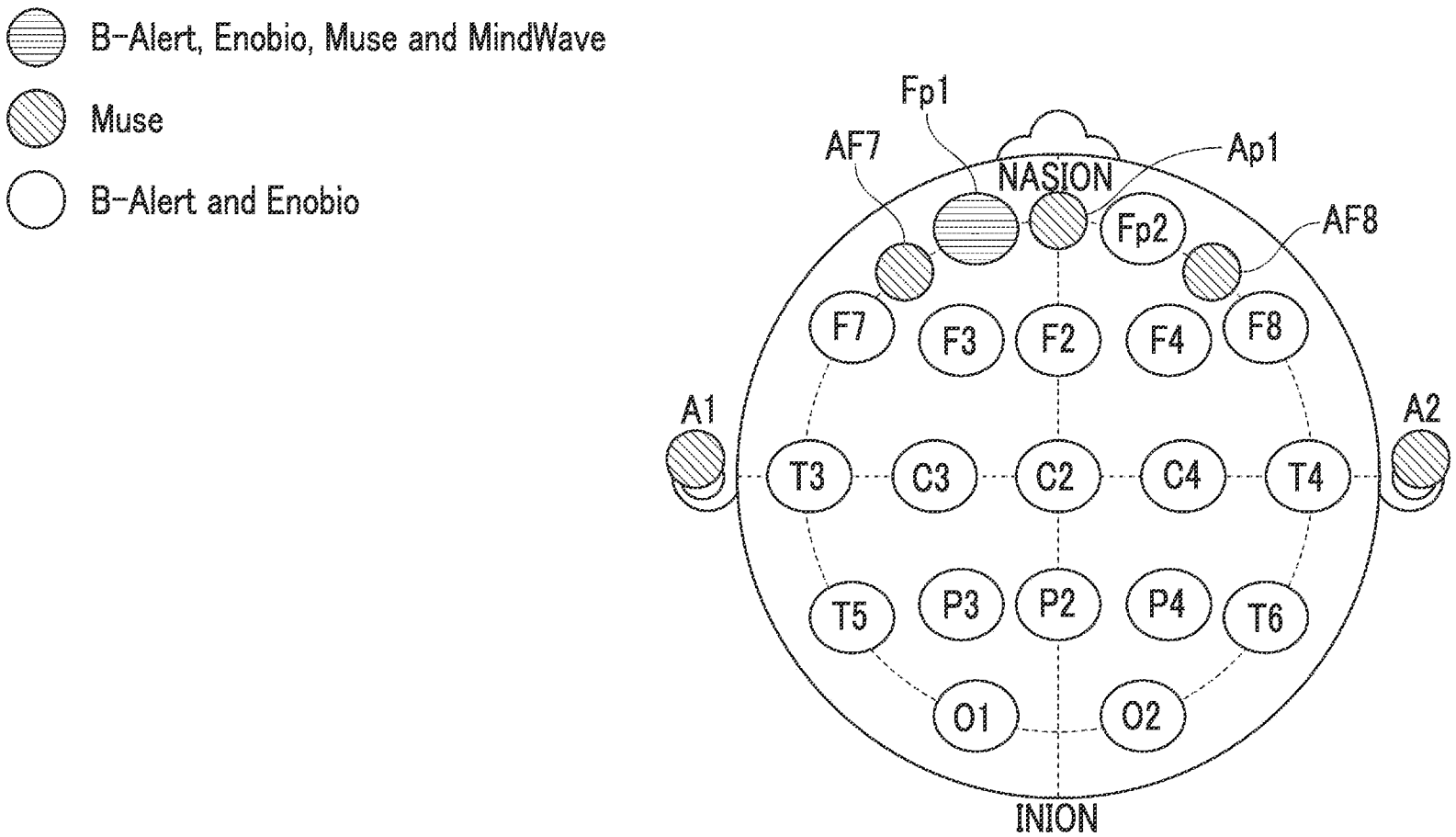
FIG. 8 is a diagram illustrating brain wave measurement points described in a paper.

FIG. 8 is a diagram illustrating the brain wave measurement points described in the paper.

B-Alert and Enobio illustrated in FIG. 8 are the names of EEG systems medically certified in Europe and the United States. Muse and MindWave are the names of EEG systems for consumers.

In FIG. 8, positions indicated by white circles are measurement points used only in the medically certified EEG system. In contrast, positions indicated by AF7, Ap1, AF8, A1, and A2 are measurement points used only in Muse which is an EEG system for consumers. Fp1 is a measurement point common to four EEG systems. That is, Fp1 is a measurement point of MindWave. Measurement points A1 and A2 correspond to parts sandwiched between the auricle and the temporal region and are not the external acoustic openings.

Although the detailed description of the paper is omitted, the measurement of the brain waves at rest is performed twice another day on five healthy subjects. In the same experiment, Fp1 of the forehead is used as a common measurement point and brain wave patterns and power spectrum densities in a state in which the eyes are closed and a state in which the eyes are opened are compared. The evaluation in this paper corresponds to the evaluation of the output of α-waves in the brain waves in a case in which the eyes are closed.

In addition, the conclusion section of the paper shows that the power spectrum measured at Fp1 of MindWave and the result of a reproducibility test are almost the same as the power spectrum and the result of a reproducibility test of B-Alert and Enobio which are medically certified EEG systems and the peak of α-waves is also captured. Further, the conclusion section shows that, in the brain waves measured by MindWave, blinking and movement during eye-opening are included as noise. In addition, it is pointed out that the reason for the low reliability of Muse is the possibility of artifacts.

Comparison of Measurement Results by Earphone 10 and Measurement Results by MindWave Next, the results of the experiment in which the subjects wear both the earphone 10 (see FIG. 7) and MindWave and brain waves are measured will be described. As illustrated in FIG. 7, the earphone 10 uses the external acoustic opening as a measurement point and MindWave uses the forehead 30A as a measurement point.

In the applicant's experiments, the number of subjects is 58. Three attention rise tests and meditation rise tests are designed for each person on the same day and an experiment to capture the appearance of α-waves during eye closure is performed.

The actual number of subjects is 83. However, the measurement results of 25 subjects are excluded since the influence of artifacts during eye-opening is excessive.

In the attention rise test, the subjects are asked to keep staring at a pen tip that is 150 mm ahead for 30 seconds with the eyes open. The purpose of this test is to create the concentrated state, to suppress the appearance of α-waves, and to increase β-waves.

In the meditation rise test, the subjects are asked to meditate for 30 seconds with the eyes closed. This test corresponds to the evaluation of the output of α-waves during eye closure. In other words, the purpose is to check the rate of increase in α-waves in the relaxed state.

In the experiments, after the attention rise test, the meditation rise test is performed to evaluate the output of α-waves.

In general, for the evaluation of the output of α-waves, two sets of the closed state of the eyes for 30 seconds after the open state of the eyes for 30 seconds are repeated and the rise of α-waves in the closed state of the eyes is checked.

However, in this experiment, the number of sets is increased in order to collect a large amount of data at once.

First, the reason for performing the meditation rise test and the method used for evaluating the output of α-waves during eye closure will be described.

Figure 9:
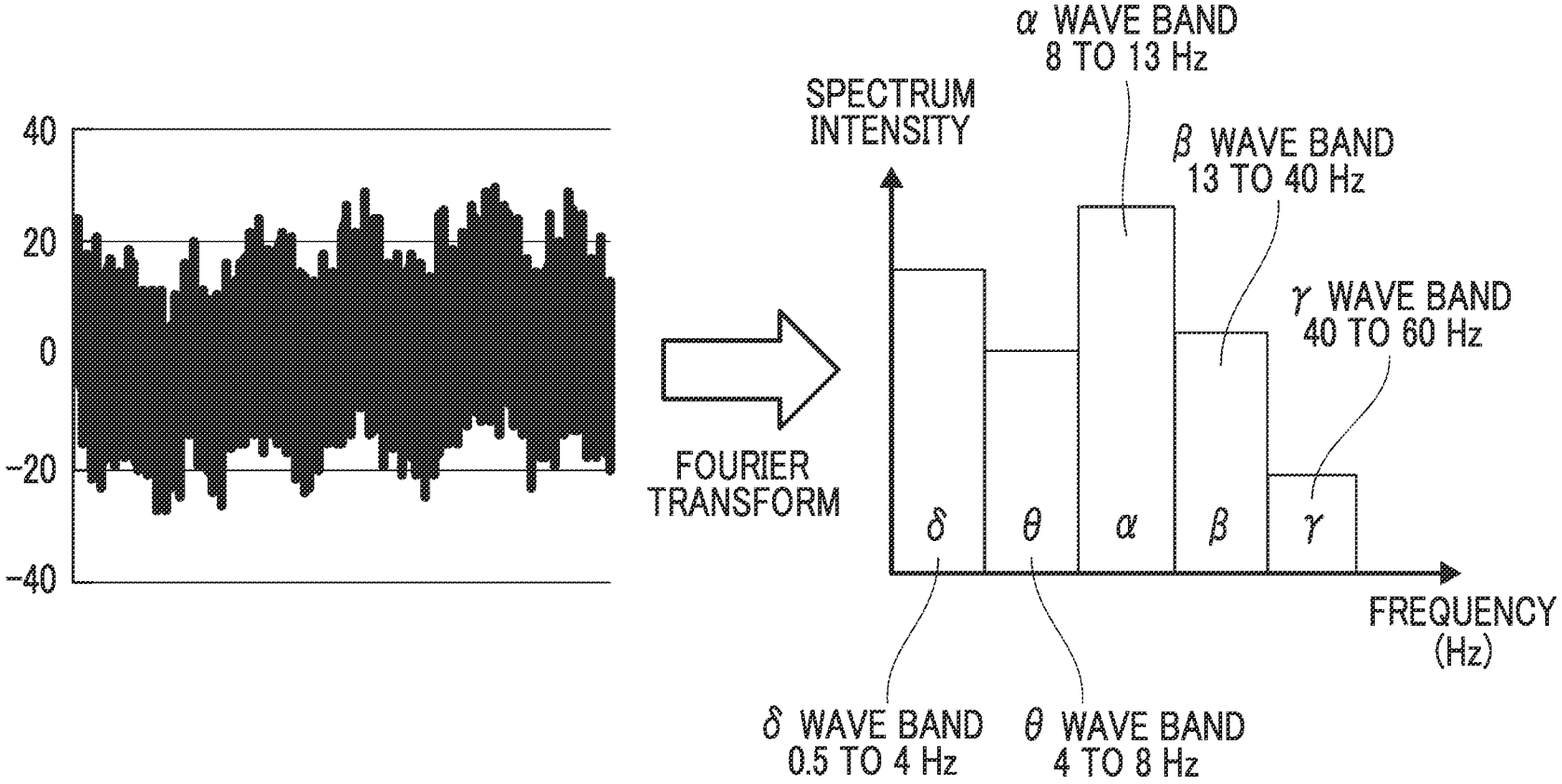
FIG. 9 is a diagram illustrating the evaluation of the output of α-waves.

FIG. 9 is a diagram illustrating the evaluation of the output of α-waves. As described above, the raw data of brain waves can be generally classified into δ-waves, θ-waves, α-waves, β-waves, and γ-waves.

It is said that the reproducibility of brain waves by human movements is low and it is difficult to evaluate the reproducibility of the acquisition performance on the basis of clinical data. However, it is said that α-waves among the brain waves are likely to appear due to the difference between eye-opening and eye closure.

It is said that any type of brain wave tends to appear uniformly in the eye-open state and waves other than the α-waves are uniformly attenuated in the eye-closed state. That is, it is said that α-waves appear while being relatively less affected even in the eye-closed state.

In experiments using this characteristic, Fourier transform is performed on the raw data of the brain waves and the spectral intensity Sn of a frequency band corresponding to each wave is used as a characteristic value.

In the experiments, an α-wave intensity ratio Tα is defined as the ratio ($=S\alpha/\Sigma Sn$) of the spectral intensity Sa of an α-wave band to the sum of the spectral intensities of all frequency bands (that is, ΣSn) and it is checked whether or not the α-wave intensity ratio Ta increases due to a change from the eye-open state to the eye-closed state.

In a case in which an increase in the α-wave intensity ratio Ta is confirmed, the increase is the evidence of the measurement of the brain waves.

Next, the difference between the measurement results by the earphone 10 and the measurement results by MindWave will be described with reference to FIGS. 10A and 10B and FIGS. 11A and 11B.

Figure 10A:
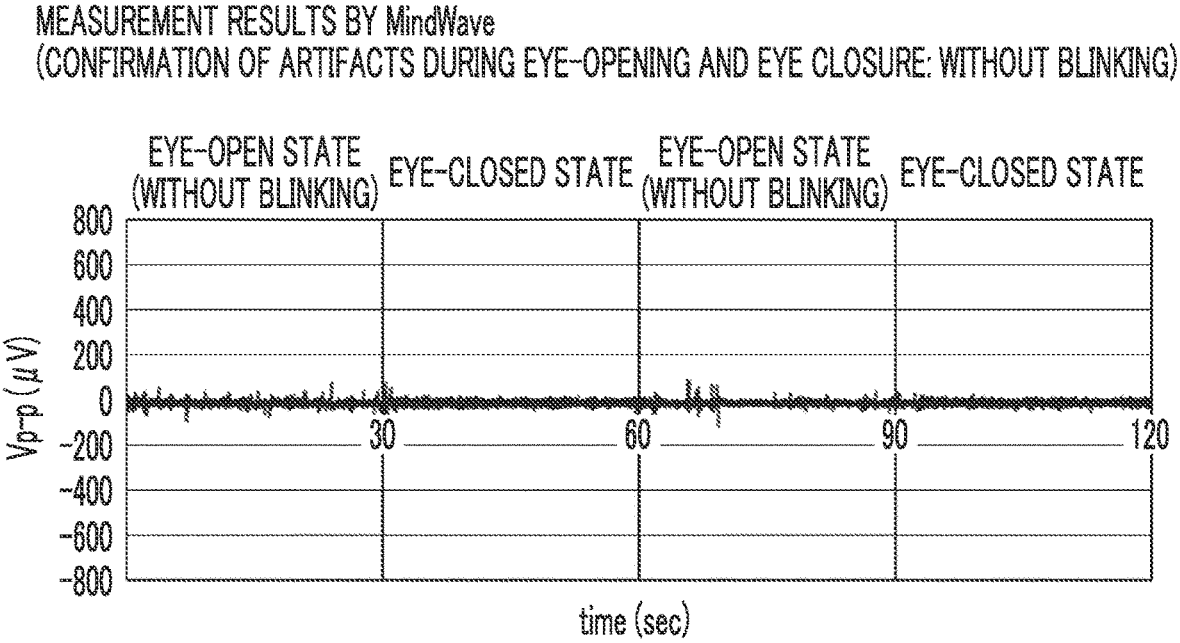
FIGS. 10A and 10B are diagrams illustrating measurement results by MindWave.
Figure 10B:
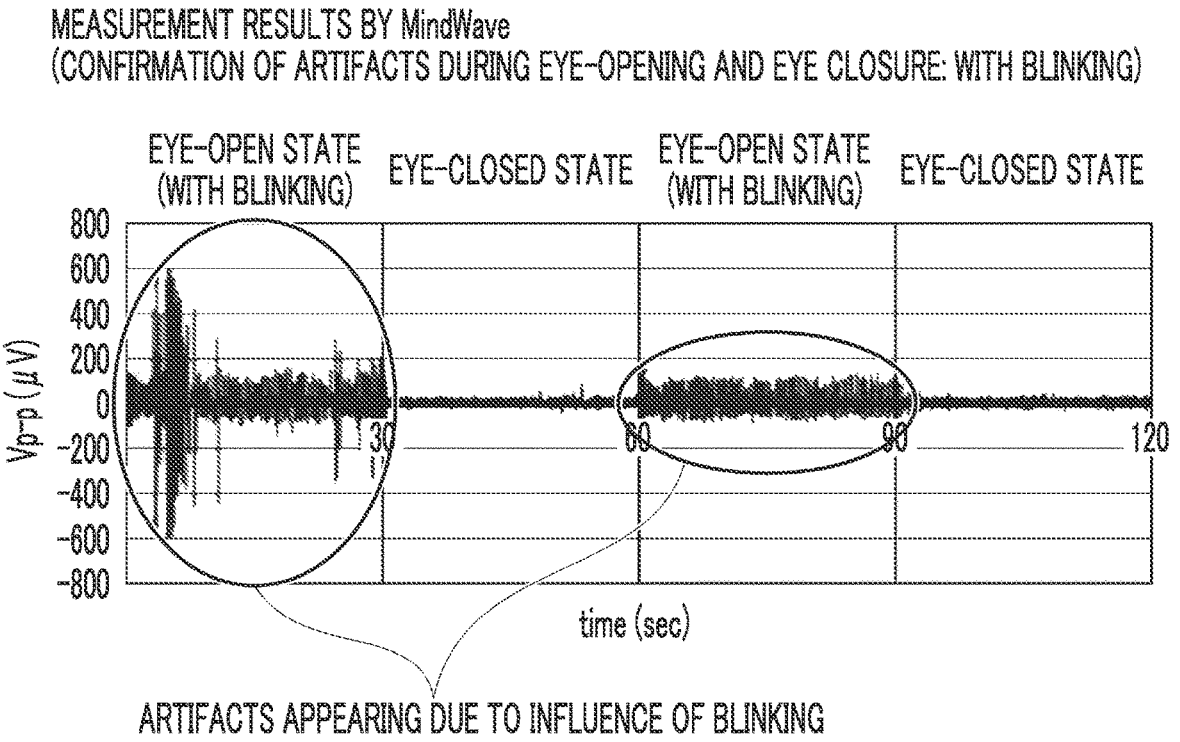

FIGS. 10A and 10B are diagrams illustrating the measurement results by MindWave.

FIG. 10A illustrates the measurement results in a case in which two sets of switching between the eye-open state and the eye-closed state without blinking are performed and FIG. 10B illustrates the measurement results in a case in which two sets of switching between the eye-open state and the eye-closed state with blinking are performed.

Figure 11A:
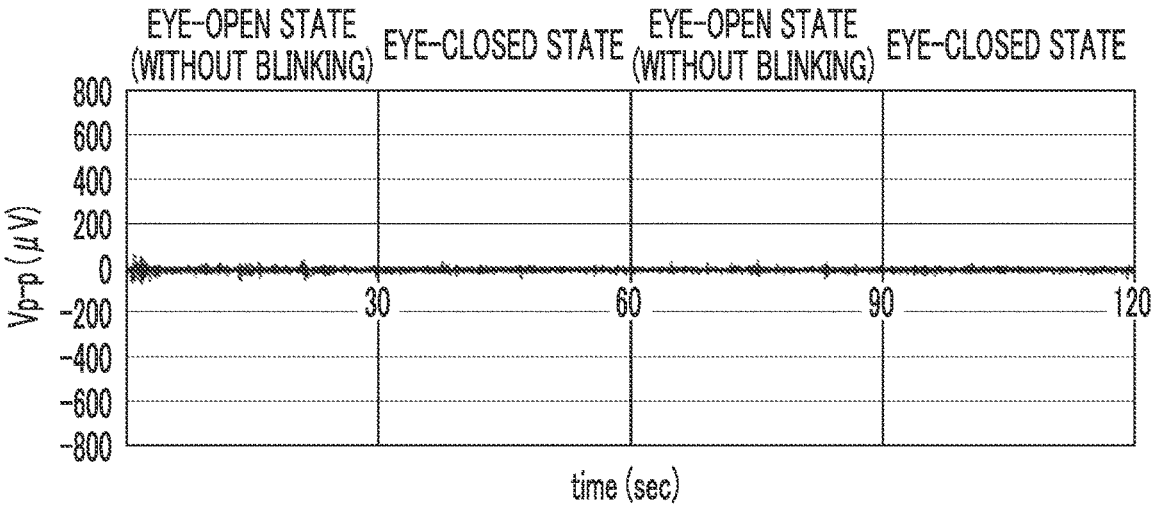
FIGS. 11A and 11B are diagrams illustrating measurement results by the earphone used in the exemplary embodiment.
Figure 11B:
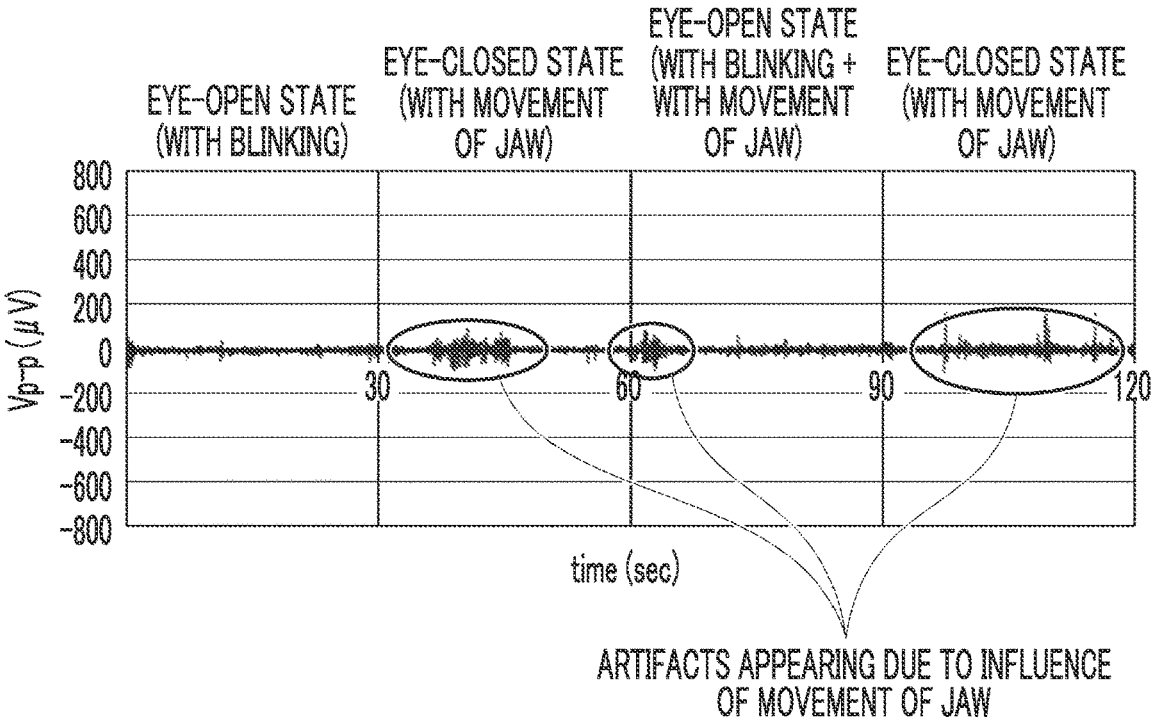

FIGS. 11A and 11B are diagrams illustrating the measurement results obtained by the earphone 10 (see FIG. 2) used in the exemplary embodiment.

FIG. 11A illustrates the measurement results in a case in which two sets of switching between the eye-open state and the eye-closed state without blinking are performed and FIG. 11B illustrates the measurement results in a case in which two sets of switching between the eye-open state and the eye-closed state with the movement of the jaw and blinking are performed.

In a case in which there is no blinking, a high similarity between the measurement results by the earphone 10 and the measurement results by MindWave is confirmed.

On the other hand, in a case in which there is blinking, artifacts affected by the blinking appear remarkably in the measurement results by MindWave. It is considered that the reason is that the forehead is close to the eyes and MindWave is likely to detect blinking as a large artifact during eye-opening. This is pointed out in the above-mentioned paper by Elena Ratti et al.

Artifacts due to the influence of blinking generally appear in the δ-wave band. However, in a case in which there is a large artifact as illustrated in FIG. 10, the possibility that an increase in α-waves will be erroneously detected increases. The reason is that, as the sum of the spectral intensities of all the frequency bands in the eye-open state increases, the α-wave intensity ratio Tα in the eye-open state decreases and the α-wave intensity ratio Tα in the eye-closed state seems to be relatively large. A reduction in the number of subjects is also for this reason.

In addition, the artifacts detected in association with blinking include not only a potential change resulting from the living body which occurs due to the movement of the eyelid, but also a potential change resulting from the brain waves related to attempts to move the eyelid.

In contrast, in the measurement results obtained by the earphone 10 (see FIG. 2) used in this exemplary embodiment, no artifacts caused by blinking are detected for a period from 0 seconds to 30 seconds.

However, it is confirmed that the artifacts caused by the movement of the jaw swallowing saliva are detected regardless of whether the eye is open or closed. The artifacts caused by the movement of the jaw swallowing saliva generally appear in the θ-wave band.

In contrast, the spectral intensity of the artifact that appears due to the swallowing of saliva is much lower than the spectral intensity of the artifact corresponding to blinking detected by MindWave. Therefore, the influence of the artifact on an increase in α-waves is not confirmed as in the case of MindWave.

The artifacts that appear due to the swallowing of saliva include not only a potential change resulting from the living body which occurs due to the movement of the jaw muscles, but also a potential change resulting from the brain waves related to attempts to move the jaw muscles.

In the above description, the reason why the operation of the jaw swallowing saliva is given as an example of the intentional movement of the muscle by the user while keeping a specific operation in mind is that the artifacts illustrated in FIGS. 11A and 11B appear.

Next, an increase in the α-waves appearing in the measurement results by the earphone 10 and an increase in the α-waves appearing in the measurement results by MindWave will be described with reference to FIGS. 12A to 12C and FIGS. 13A to 13C.

Figure 12A:
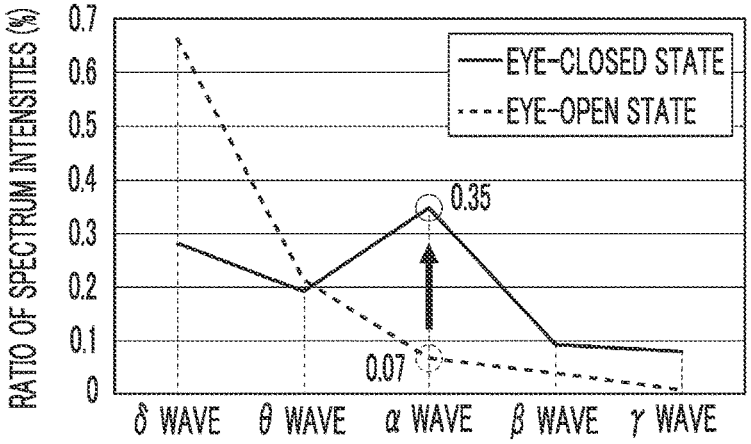
FIGS. 12A, 12*b* and 12C are diagrams illustrating measurement results by MindWave.
Figure 12B:
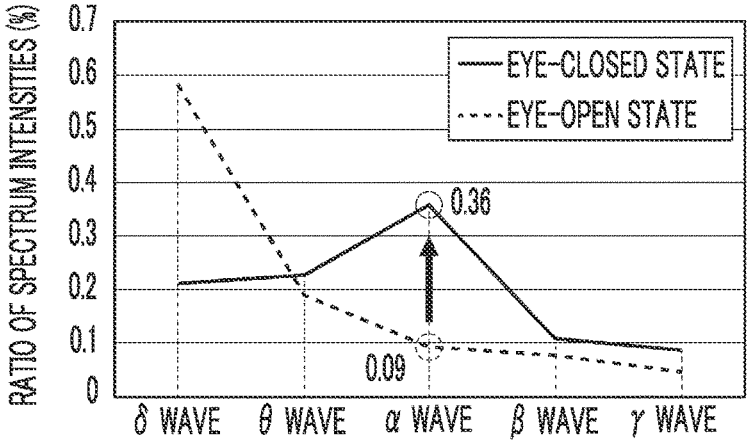
Figure 12C:
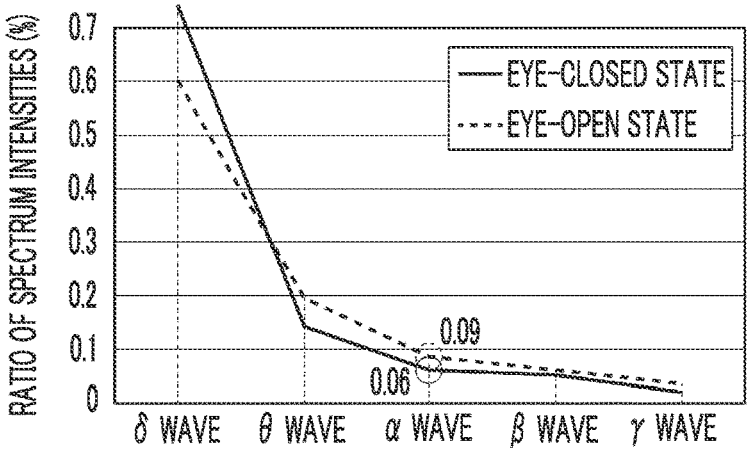

FIGS. 12A to 12C are diagrams illustrating the measurement results by MindWave.

FIG. 12A illustrates a change in the ratio of the spectrum intensities for each frequency band in a case in which the state changes from a state in which the eyes are open and there is blinking to the eye-closed state. FIG. 12B illustrates a change in the ratio of the spectrum intensities for each frequency band in a case in which the state changes from a state in which the eyes are open and there is no blinking to the eye-closed state. FIG. 12C illustrates a case in which an increase in α-waves does not appear.

FIGS. 13A to 13C are diagrams illustrating the measurement results by the earphone 10 (see FIG. 2) used in the exemplary embodiment. FIG. 13A illustrates a change in the ratio of the spectrum intensities for each frequency band in a case in which the state changes from a state in which the eyes are open and there is blinking to the eye-closed state. FIG. 13B illustrates a change in the ratio of the spectrum intensities for each frequency band in a case in which the state changes from a state in which the eyes are open and there is no blinking to the eye-closed state. FIG. 13C illustrates a case in which an increase in α-waves does not appear.

In FIGS. 12A to 12C and FIGS. 13A to 13C, the vertical axis indicates the ratio of the spectrum intensities and the horizontal axis indicates the frequency band. The subject corresponding to FIG. 12A and the subject corresponding to FIG. 13A are the same. Similarly, the subject corresponding to FIG. 12B and the subject corresponding to FIG. 13B are the same. Similarly, the subject corresponding to FIG. 12C and the subject corresponding to FIG. 13C are the same.

The distribution of the spectrum intensity of MindWave (see FIGS. 12A to 12C) and the distribution of the spectrum intensity of the earphone 10 (see FIGS. 13A to 13C) are different in a low frequency band from δ-waves to θ-waves and are substantially the same in α-waves and waves above the α-waves.

The results of the experiment show that an increase in α-waves is confirmed in 46 subjects in both MindWave and the earphone 10. This ratio corresponds to about 80% of 58 subjects.

Incidentally, the increase in α-waves is confirmed in 7 subjects only in the earphone 10. In other words, in the earphone 10, the increase in α-waves is confirmed in a total of 53 subjects. That is, in the earphone 10, the increase in α-waves is confirmed in about 90% or more of the subjects.

In addition, the increase in α-waves is not confirmed in 5 subjects in both MindWave and the earphone 10. The waveforms illustrated in FIGS. 12C and 13C show the measurement results of the five subjects.

Figure 14A:
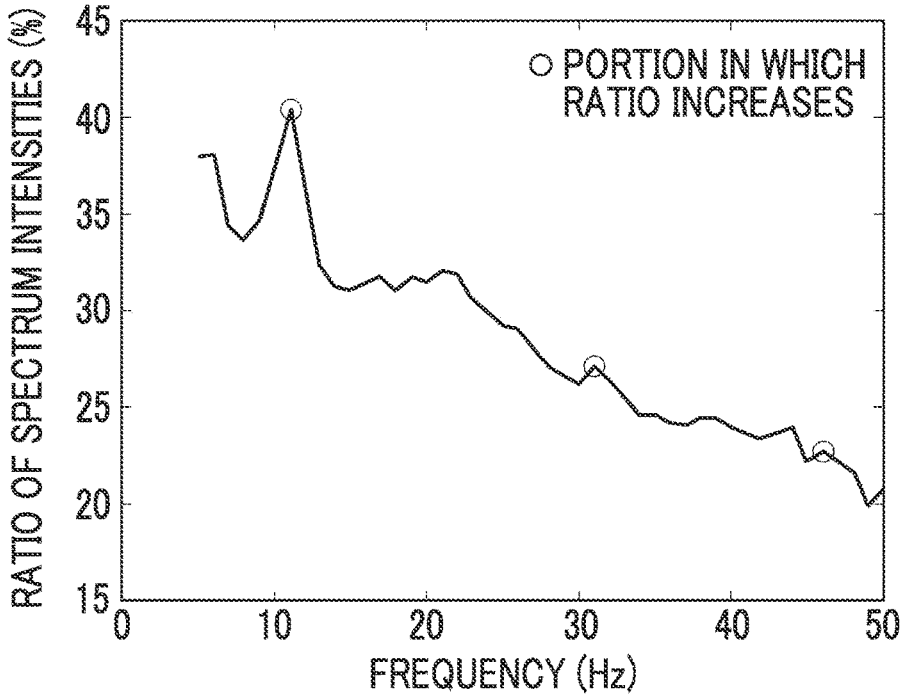
FIGS. 14A and 14B are diagrams illustrating an example of the presentation of a portion in which the spectrum intensity increases.
Figure 14B:
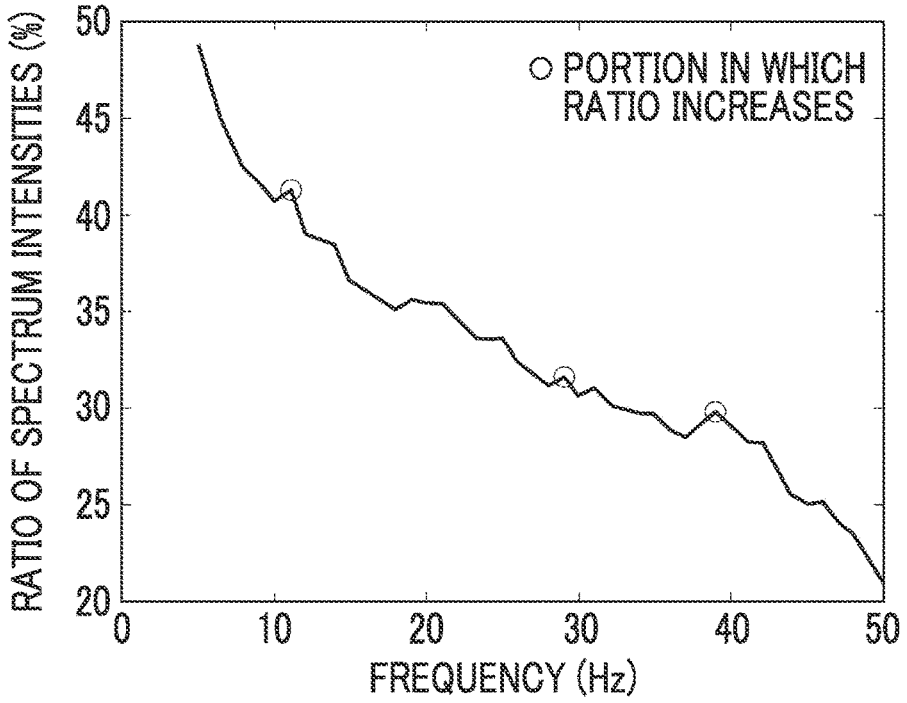

FIGS. 14A and 14B are diagrams illustrating an example of the presentation of a portion in which spectrum intensity increases. FIG. 14A illustrates the measurement results obtained by MindWave and FIG. 14B illustrates the measurement results obtained by the earphone 10 (see FIG. 2) used in the exemplary embodiment. The vertical axis is the ratio of spectrum intensities and the horizontal axis is a frequency.

In FIGS. 14A and 14B, unlike FIGS. 12A and 12B and FIGS. 13A and 13B, the horizontal axis indicates the actual frequency. In the above-mentioned paper by Elena Ratti et al., an increase in α-waves is described using the actual frequency on the horizontal axis. A portion indicated by a circle in FIGS. 14A and 14B is the portion in which the spectrum intensity increases.

As illustrated in FIGS. 14A and 14B, in any measurement method, the ratio of the spectrum intensities tends to decrease as the frequency increases. This tendency is similar to that in the paper by Elena Ratti et al.

As described above, it is confirmed that the earphone 10 used to measure brain waves in the external acoustic opening in this exemplary embodiment has the same measurement capability as MindWave.

Other Exemplary Embodiments

The exemplary embodiment of the invention has been described above. However, the technical scope of the invention is not limited to the scope described in the above exemplary embodiment. It is apparent from the description of the claims that various modifications or improvements of the above-described exemplary embodiment are included in the technical scope of the invention.

For example, in the above-described exemplary embodiment, the brain waves have been described as an example of the potential change that can be measured by the earphone 10 (see FIG. 1). However, for example, a myoelectric potential, a heartbeat, an electrocardiogram, a pulse, and a pulse wave are also included. That is, for example, the myoelectric potential, the heartbeat, the electrocardiogram, the pulse, and the pulse wave are also examples of biological information measured at the head.

In the above-described exemplary embodiment, the earphones 10 are put into the external acoustic openings of both ears to measure brain waves. However, the earphone 10 may be a type that is put into the external acoustic opening of one ear.

Figure 15:
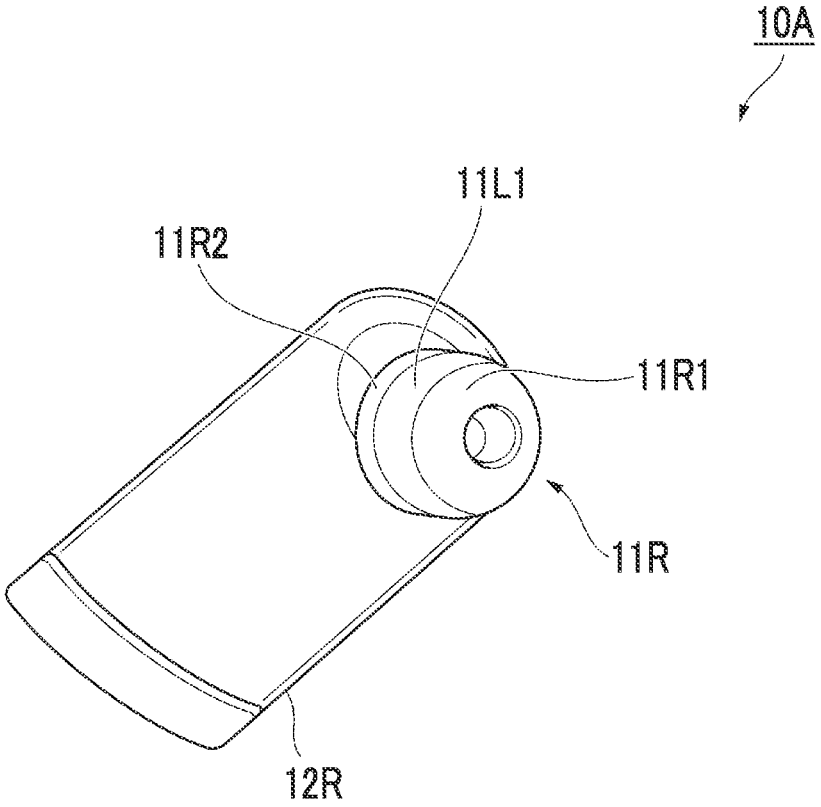
FIG. 15 is a diagram illustrating an example of the outward appearance of an earphone of a type that is worn on one ear.

FIG. 15 is a diagram illustrating an example of the outward appearance of an earphone 10A that is put into one ear. In FIG. 15, components corresponding to the components in FIG. 2 are denoted by corresponding reference numerals. In the case of the earphone 10A illustrated in FIG. 15, an earphone chip 11R has a leading end and a main body which are electrically separated from each other by an insulating ring. An electrode 11R1 is provided at the leading end and an electrode 11L1 is provided in the main body. An electrode 11R2 as a GND terminal is electrically separated from the electrode 11L1 by an insulator (not illustrated).

In the case of this configuration, a lithium battery 128 (see FIG. 3) is also provided in an earphone main body 12R.

In the above-described exemplary embodiment, the earphone 10 (see FIG. 1) has only the function of sensing a potential change and the information terminal 20 (see FIG. 1) or the like has the function of estimating the content of an operation according to the characteristics of, for example, brain wave information. However, the earphone 10 may have the function of estimating the content of an operation according to the characteristics of, for example, brain wave information. In this case, only the earphone 10 is an example of the information processing system.

Further, in the above-described exemplary embodiment, for example, the information terminal 20 (see FIG. 1) has the function of estimating the content of an operation according to the characteristics of, for example, brain wave information. However, a portion or all of the function of estimating the content of an operation according to the characteristics of, for example, brain wave information may be implemented by a server on the Internet. In this case, the server is an example of the information processing system.

In the above-described exemplary embodiment, the MPU 202 (see FIG. 4) of the information terminal 20 (see FIG. 1) controls the volume of the ambient sound output from both the right-ear-side earphone chip 11R and the left-ear-side earphone chip 11L of the earphone 10 (see FIG. 1). However, the MPU 202 may control the volume of the ambient sound output from only one of the earphone chips. The control target may be switched by the selection of the user. The control target may be switched by the manager of the earphone 10.

In the above-described exemplary embodiment, the example in which the electrode for measuring a potential change caused by, for example, brain waves is provided in the earphone 10 has been described. However, the electrode may be provided in other articles. Next, some specific examples will be described.

For example, the electrode for measuring a potential change caused by, for example, brain waves may be provided in headphones that cover the auricle. In the case of the headphones, the electrode is provided in a portion of an ear pad which comes into contact with the head. In this case, the electrode is disposed at a position where the hair is thin and which can come into direct contact with the skin.

Further, the article that comes into contact with the auricle may be a spectacle-type device. The devices are examples of a wearable device.

Figure 16:
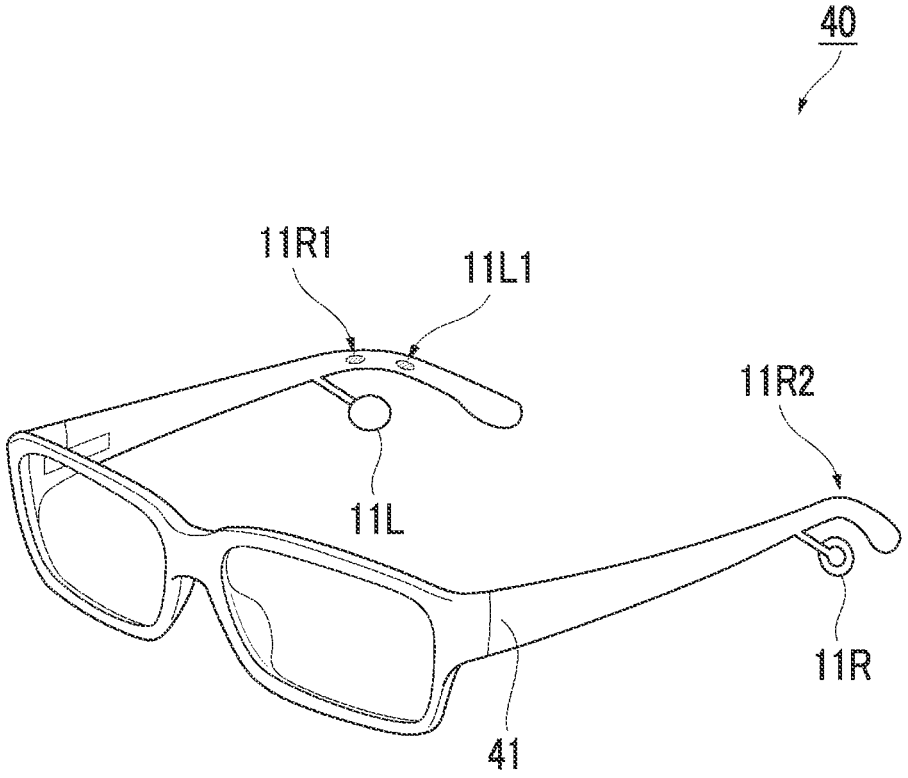
FIG. 16 is a diagram illustrating an example of glasses in which an electrode used to measure brain waves is provided in a temple of a frame.

FIG. 16 is a diagram illustrating an example of glasses 40 in which an electrode used to measure brain waves is provided in a temple of a frame 41. The glasses 40 have a configuration in which the earphone chips 11R and 11L are provided with only the speakers 123 (see FIG. 3) in the internal configuration illustrated in FIG. 3 and the other components are provided in the frame 41.

As illustrated in FIG. 16, the earphone chips 11R and 11L are attached to the temples of the frame 41 and are worn by the user so as to cover the external acoustic openings.

In FIG. 16, the electrode 11R1 and the electrode 11L1 are provided at the tip (hereinafter referred to as a "modern") of the right temple and the electrode 11R2 is provided at the modern of the left temple. The electrodes are electrically separated from each other by an insulator (not illustrated). In addition, a battery that supplies power required for operations, a Bluetooth module, and other communication modules are provided in the temple or the modern.

In addition, the electrode used to measure brain waves may be combined with a smart glass or a headset that displays information and is called a head-mounted display. Further, the electrode may be provided in a headset that has a function of understanding the environment around the user and displaying an image assimilated to the environment.

Figure 17A:
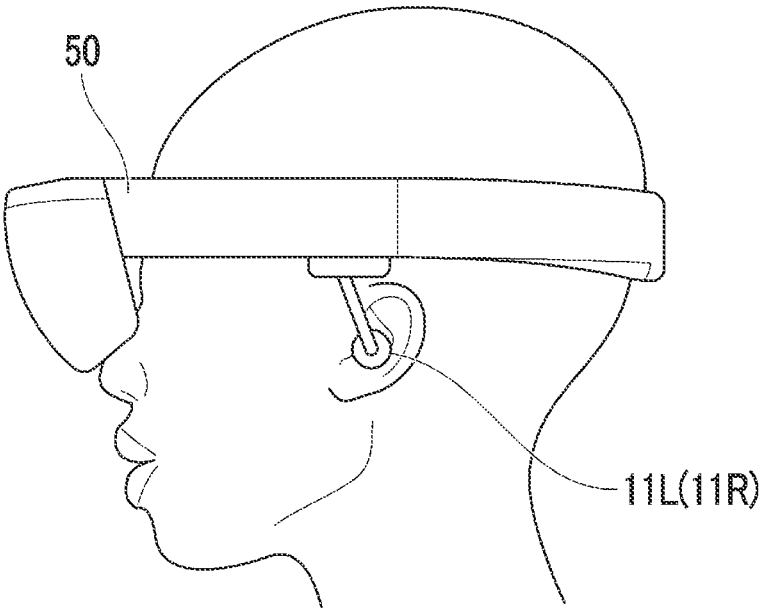
FIGS. 17A and 17B are diagrams illustrating an example of the arrangement of electrodes is used to measure brain waves in a headset having a function of displaying an image assimilated to an environment around the user.
Figure 17B:
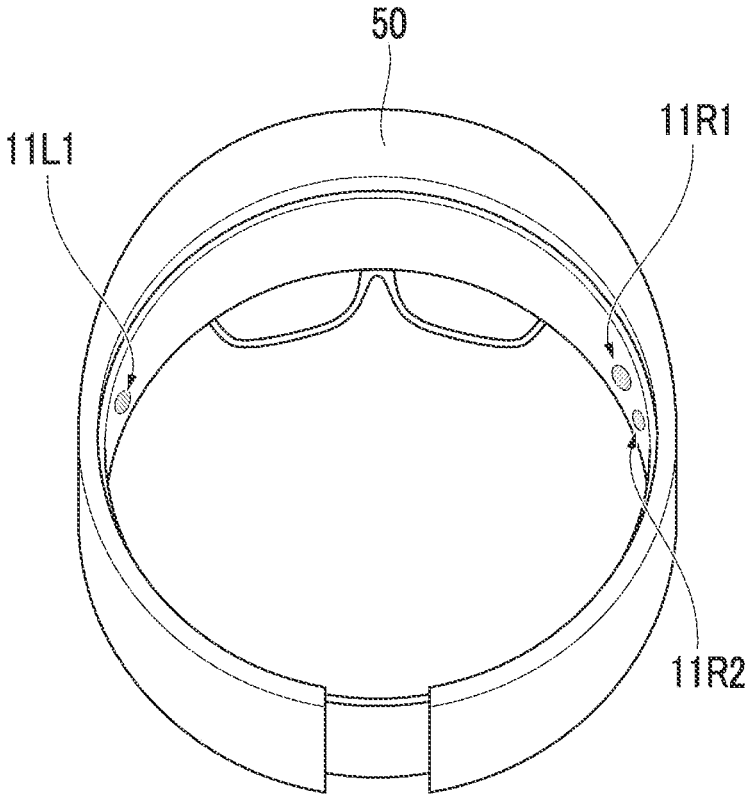

FIGS. 17A and 17B are diagrams illustrating an example of the arrangement of electrodes is used to measure brain waves in a headset 50 having a function of displaying an image assimilated to the environment around the user.

FIG. 17A is a diagram illustrating an example of the mounting of the headset 50 and FIG. 17B is a diagram illustrating an example of the arrangement of the electrodes 11R1, 11R2, and 12L1 in the headset 50.

The headset 50 illustrated in FIGS. 17A and 17B has a configuration in which the electrodes 11R1, 11R2, and 11L1 are attached to Hololens (registered trademark) manufactured by Microsoft Corporation (registered trademark). A virtual environment experienced by the user who wears the headset 50 is called augmented reality or mixed reality.

In the headset 50 illustrated in FIGS. 17A and 17B, the electrodes 11R1, 11R2, and 11L1 are provided in portions which come into contact with the ears in a ring-shaped member worn on the head. In the case of the headset 50 illustrated in FIGS. 17A and 17B, the electrode 11R1 and the electrode 11R2 are provided on the right ear side and the electrode 11L1 is provided on the left ear side.

Similarly to the case of the glasses 40 (see FIG. 16), the earphone chips 11R and 11L which are provided with only the speakers 123 (see FIG. 3) and are worn by the user so as to cover the external acoustic openings are attached to the headset 50.

In the case of this configuration, devices other than the speaker 123 in the configuration illustrated in FIG. 3 are provided in the main body of the headset 50.

In the above-described exemplary embodiment, the case in which biological information including brain waves is acquired using the electrode that comes into contact with the ear of the user has been described. However, the position where biological information including brain waves is acquired is not limited to the ears. For example, the electrodes may be provided at the forehead and other positions of the head.

Figure 18:
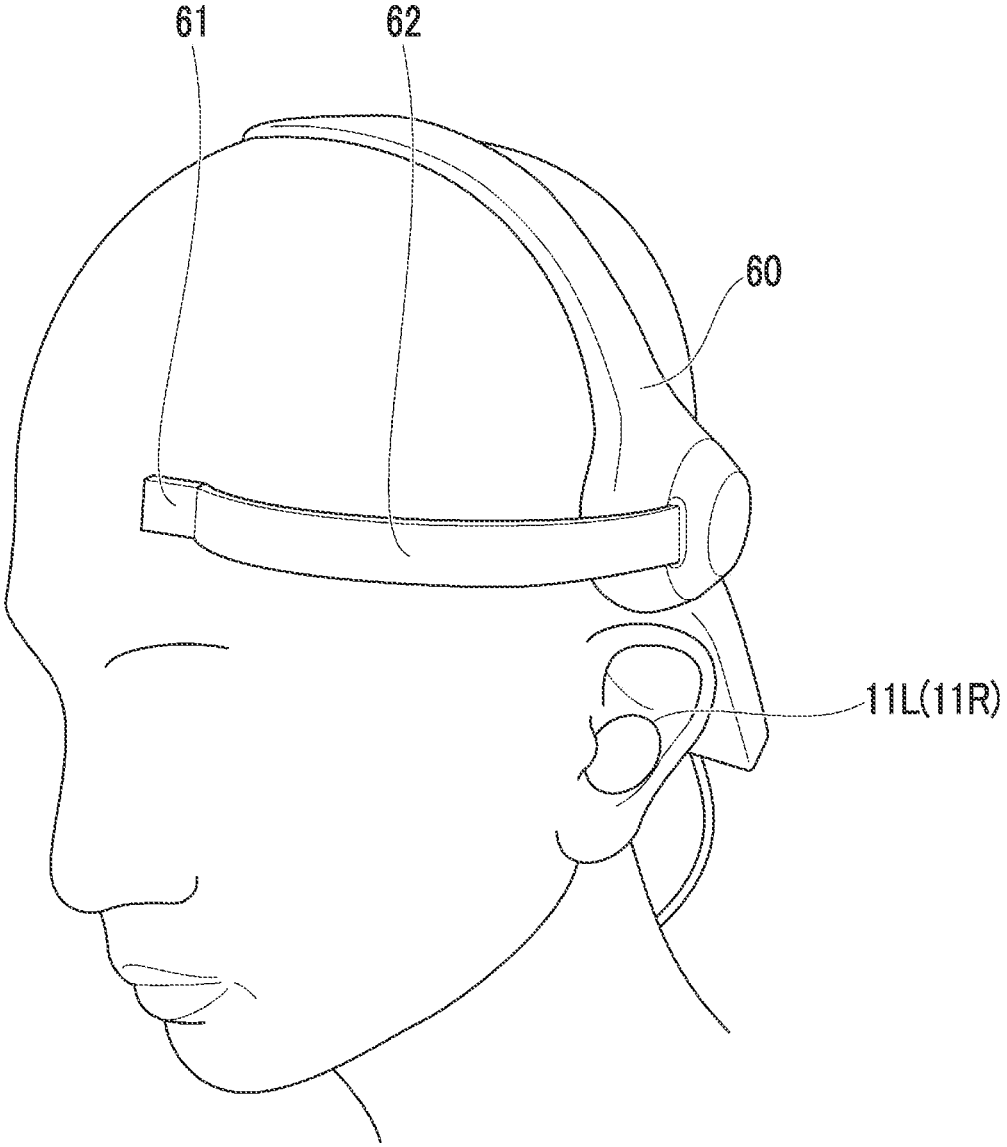
FIG. 18 is a diagram illustrating an example of the mounting of a device which is a combination of a headset that measures brain waves at the forehead and a commercially available earphone.

FIG. 18 is a diagram illustrating an example of the mounting of a device which is a combination of a headset 60 that measures brain waves at the forehead and commercially available earphone chips 11R and 11L.

In the case of FIG. 18, one end of an arm 62 for pressing an electrode 61 against the forehead is attached to the left head side of the headset 60. In addition, the earphone chips 11R and 11L provided with only the speakers 123 (see FIG. 3) are attached to the headset 60. The earphone chips 11R and 11L are also worn by the user so as to cover the external acoustic openings.

In addition, for example, the electrodes 11R1, 11R2, and 11L1 of the headset 50 (see FIGS. 17A and 17B) may be provided at positions other than the ears in a ring-shaped member that is worn on the head.

In the above-described exemplary embodiment, the case in which biological information including brain waves is acquired using the electrode that comes into contact with the head including the ears of the user has been described. However, the activity of the brain may be measured by a change in blood flow.

Figure 19:
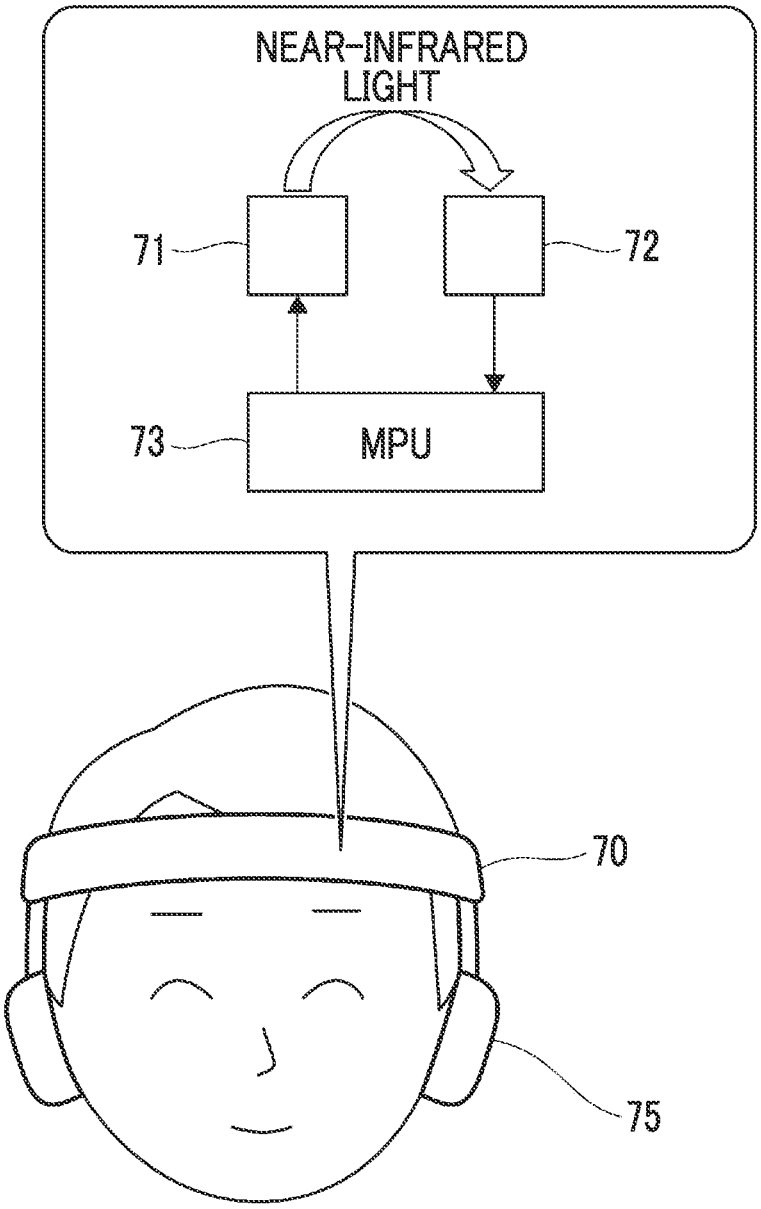
FIG. 19 is a diagram illustrating an example of a headset that measures a change in blood flow caused by activity of the brain using near-infrared light.

FIG. 19 is a diagram illustrating an example of a headset 70 that measures a change in blood flow caused by the activity of the brain using near-infrared light. The headset 70 has a ring-shaped main body that is worn on the head. One or a plurality of measurement units each of which includes a probe 71 for irradiating the scalp with near-infrared light and a detection probe 72 for receiving reflected light are provided in the main body. An MPU 73 controls the irradiation of near-infrared light by the probe 71, processes a signal output from the detection probe 72, and detects the characteristics of the brain waves of the user. In the case of FIG. 19, the user wears headphones 75 that cover the auricle. The headphones 75 include only the speakers 123 (see FIG. 3), similar to the earphone chips 11R and 11L (see FIG. 18). Devices other than the speaker 123 in the configuration illustrated in FIG. 3 are provided in the main body of the headset 70.

In addition, magnetoencephalography may be used to acquire biological information including brain waves. For example, a tunnel magneto resistance (TMR) sensor is used to measure the magnetic field generated by electrical activity generated by nerve cells of the brain.

Figure 20:
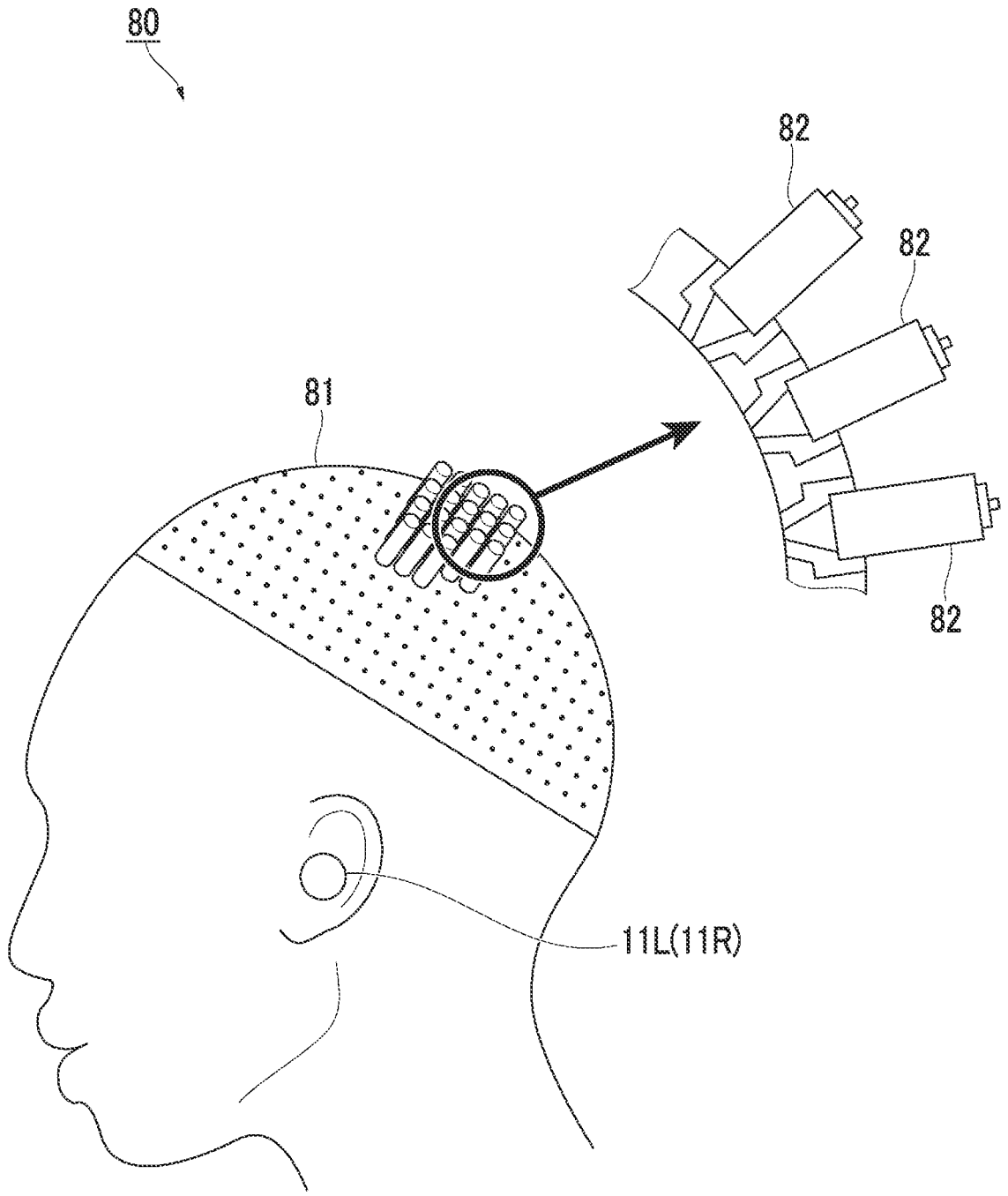
FIG. 20 is a diagram illustrating an example of a magnetoencephalograph.

FIG. 20 is a diagram illustrating an example of a magnetoencephalograph 80. The magnetoencephalograph 80 illustrated in FIG. 20 has a structure in which a plurality of TMR sensors 82 are arranged in a cap 81 worn on the head. The output of the TMR sensor 82 is input to an MPU (not illustrated) and a magnetoencephalogram is generated. In this case, the distribution of the magnetic field in the magnetoencephalogram is used as the characteristics of the brain waves of the user. The earphone chips 11R and 11L that are provided with only the speakers 123 (see FIG. 3) and are worn by the user so as to cover the external acoustic openings are attached to the magnetoencephalograph 80.

In this configuration, devices other than the speaker 123 in the configuration illustrated in FIG. 3 are provided in the main body of the magnetoencephalograph 80.

The MPU in each of the above-described exemplary embodiments indicates a processor in a broad sense. Examples of the processor include general processors (e.g., CPU: Central Processing Unit), dedicated processors (e.g., GPU: Graphics Processing Unit, ASIC: Application Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An information processing device worn on a head of a user, comprising:

a speaker that is configured to output sound information to the user wearing the device;

a display device that is configured to display image information to the user wearing the device;

a sensor that is configured to measure biological information at the head of the user wearing the device, wherein the sensor is configured to obtain, as the biological information of the user, a bioelectric potential of the user;

a differential amplifier circuit that is configured to amplify the bioelectric potential obtained by the sensor; and a circuit that is configured to separately generate a measurement signal indicating a potential resulting from brain waves and a measurement signal indicating a potential resulting from a biological signal other than the brain waves; and a processor for controlling the device, the processor being configured to:

obtain the biological information of the user measured by the sensor, and control the sound information output from the speaker in accordance with the obtained biological information.

2. The information processing device according to claim 1, further comprising a microphone that is configured to collect an ambient sound of the user, wherein the processor is configured to change a volume of the sound information collected by the microphone and output from the speaker in accordance with the obtained biological information.

3. The information processing device according to claim 2, wherein the speaker is worn so as to cover an external acoustic opening an ear of the user, the display device is configured to display the image information so that the image information is overlapped at a direction of a field of view of the user.

4. The information processing device according to claim 3, wherein the bioelectric potential comprises brain wave.

5. The information processing device according to claim 2, wherein the processor is configured to change a collection amount of the sound information of the microphone in accordance with the obtained biological information.

6. The information processing device according to claim 2, wherein, in a case in which the biological information indicates a user's state in which the user is concentrated, the processor is configured to reduce the volume of the sound information collected by the microphone and output from the speaker.

7. The information processing device according to claim 6, wherein, in a case in which the sound information collected by the microphone satisfies a predetermined condition, the processor is configured to increase the volume of the sound information output from the speaker.

8. The information processing device according to claim 7, wherein the predetermined condition comprises acquisition of a voice including a predetermined term indicating danger or acquisition of a predetermined type of sound indicating danger.

9. The information processing device according to claim 6, wherein, in a case in which the biometric information indicates a change of the user's state from the concentrated state, the processor is configured to reproduce the sound information collected during the user has been concentrated, or to confirm whether or not the user wants to reproduce the collected sound information.

10. The information processing device according to claim 2, wherein, in a case in which the biological information indicates a user's state in which the user is asleep, the processor is configured to stop output of the sound information from the speaker.

11. The information processing device according to claim 10, wherein, in a case in which the sound information collected by the microphone satisfies a predetermined condition, the processor is configured to increase the volume of the sound information output from the speaker.

12. The information processing device according to claim 2, wherein, in a case in which the biological information indicates a user's state in which the user is in an unpleasant state, the processor is configured to reduce the volume of the sound information collected by the microphone and output from the speaker.

13. The information processing device according to claim 1, wherein the sensor comprises a plurality of electrodes that contact with an ear of the user.

14. The information processing device according to claim 1, wherein the processor is configured to:

understand an environment around the user, and causes the display device to display image information according to the environment.

15. The information processing device according to claim 1, wherein the display device comprises a transparent glass through which a real space is visible at a direction of a field of view of the user.

16. A control method of an information processing device worn on a head of a user, the information processing device including a speaker that is configured to output sound information to the user wearing the device, a display device that is configured to display image information to the user wearing the device, a sensor that is configured to measure biological information at the head of the user wearing the device, wherein the sensor is configured to obtain, as the biological information of the user, a bioelectric potential of the user, a differential amplifier circuit that is configured to amplify the bioelectric potential obtained by the sensor; and a circuit that is configured to separately generate a measurement signal indicating a potential resulting from brain waves and a measurement signal indicating a potential resulting from a biological signal other than the brain waves, the control method comprising:

obtaining the biological information of the user measured by the sensor, and controlling the sound information output from the speaker in accordance with the obtained biological information.

17. The control method according to claim 16, wherein the information processing device includes a microphone that is configured to collect an ambient sound of the user, and the method further comprising changing a volume of the sound information collected by the microphone and output from the speaker in accordance with the obtained biological information.

18. A non-transitory storage medium storing a program that causes a processor of an information processing device to perform control processing of the device, the information processing device being worn on a head of a user, and including a speaker that is configured to output sound information to the user wearing the device, a display device that is configured to display image information to the user wearing the device, a sensor that is configured to measure biological information at the head of the user wearing the device, wherein the sensor is configured to obtain, as the biological information of the user, a bioelectric potential of the user, a differential amplifier circuit that is configured to amplify the bioelectric potential obtained by the sensor; and a circuit that is configured to separately generate a measurement signal indicating a potential resulting from brain waves and a measurement signal indicating a potential resulting from a biological signal other than the brain waves, the control processing comprising:

obtaining the biological information of the user measured by the sensor, and controlling the sound information output from the speaker in accordance with the obtained biological information.

19. The non-transitory storage medium according to claim 18, wherein the information processing device includes a microphone that is configured to collect an ambient sound of the user, and the control processing further comprising changing a volume of the sound information collected by the microphone and output from the speaker in accordance with the obtained biological information.

* * * * *